US008172034B2

(12) United States Patent
Fullerton

(10) Patent No.: US 8,172,034 B2
(45) **Date of Patent: *May 8, 2012**

(54) SYSTEM AND METHOD FOR GENERATING AND DIRECTING VERY LOUD SOUNDS

(75) Inventor: Larry W. Fullerton, New Hope, AL (US)

(73) Assignee: Soundblast Technologies LLC, Winter Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/015,876

(22) Filed: Jan. 28, 2011

(65) Prior Publication Data

US 2011/0120335 A1 May 26, 2011

Related U.S. Application Data

(63) Continuation of application No. 11/785,320, filed on Apr. 17, 2007, now Pat. No. 7,882,926.

(60) Provisional application No. 60/792,420, filed on Apr. 17, 2006, provisional application No. 60/850,683, filed on Oct. 10, 2006.

(51) Int. Cl.
*G01V 1/06* (2006.01)

(52) U.S. Cl. ..... 181/117; 181/118; 89/7; 102/355; 102/363; 102/403

(58) Field of Classification Search ..... 181/117, 181/118; 89/7; 102/355, 363, 403
See application file for complete search history.

(56) References Cited

U.S. PATENT DOCUMENTS 2,994,397 A 8/1961 Huckabay et al.
3,048,816 A 8/1962 Lubnow
3,064,753 A * 11/1962 McClure ..... 181/118
3,099,813 A 7/1963 Anderson et al.
(Continued)

FOREIGN PATENT DOCUMENTS

GB 934 749 8/1963
(Continued)

OTHER PUBLICATIONS

International Search Report dated Apr. 24, 2008 Issued in International Application No. PCT/US2007/09441.
(Continued)

*Primary Examiner* — John Woodrow Eldred
(74) *Attorney, Agent, or Firm* — Venable LLP; Robert S. Babayi; Christopher Ma

(57) ABSTRACT

An improved system and method for controlling and directing sound waves is provided. A fuel-oxidant mixture is supplied to at least one detonator having at least one spark initiator. The fuel-oxidant mixture flows through the at least one detonator and into the closed end of at least one detonation tube also having an open end. The timing at least one spark initiator is controlled to initiate at least one spark within the at least one detonator while the fuel-oxidant mixture is flowing through the at least one detonator thereby initiating a detonation wave at the closed end of the at least one detonation tube. The detonation wave propagates the length of the at least one detonation tube and exits the open end of the at least one detonation tube as a sound wave. When multiple detonation tubes are detonated with controlled timing, the resulting sound waves are directed to a desired location. Sound waves can be directed from groups of detonation tubes and from a sparse array of detonation tubes.

20 Claims, 15 Drawing Sheets

U.S. PATENT DOCUMENTS

| | | | | | |
|---|---|---|---|---|---|
| 3,233,694 | A | | 2/1966 | Roever | |
| 3,235,026 | A | | 2/1966 | Hottman | |
| 3,410,142 | A | | 11/1968 | Diaber et al. | |
| 3,412,394 | A | | 11/1968 | Lewis et al. | |
| 3,828,886 | A | | 8/1974 | Holloway | |
| 3,897,195 | A | | 7/1975 | Finch | |
| 4,043,420 | A | | 8/1977 | Zens et al. | |
| 4,356,753 | A | | 11/1982 | Galley | |
| 4,642,611 | A | | 2/1987 | Koerner | |
| 4,662,844 | A | | 5/1987 | Gallagher et al. | |
| 4,664,631 | A | | 5/1987 | Pederson et al. | |
| 4,741,154 | A | | 5/1988 | Eidelman | |
| 5,345,758 | A | | 9/1994 | Bussing | |
| 5,430,691 | A | * | 7/1995 | Fridman | 367/145 |
| 5,473,885 | A | | 12/1995 | Hunter, Jr. et al. | |
| 5,513,489 | A | | 5/1996 | Bussing | |
| 5,579,633 | A | | 12/1996 | Hunter, Jr. et al. | |
| 5,644,314 | A | | 7/1997 | Ahmad et al. | |
| 5,800,153 | A | | 9/1998 | DeRoche | |
| 5,855,827 | A | | 1/1999 | Bussing et al. | |
| 5,864,517 | A | * | 1/1999 | Hinkey et al. | 367/145 |
| 5,873,240 | A | | 2/1999 | Bussing et al. | |
| 5,937,635 | A | | 8/1999 | Winfree et al. | |
| 5,973,999 | A | | 10/1999 | Naff et al. | |
| 6,003,301 | A | | 12/1999 | Bratkovich et al. | |
| 6,062,018 | A | | 5/2000 | Bussing | |
| 6,360,173 | B1 | | 3/2002 | Fullerton | |
| 6,408,614 | B1 | | 6/2002 | Eizenhofer | |
| 6,813,878 | B2 | | 11/2004 | Kraft | |
| 6,928,804 | B2 | | 8/2005 | Venkataramani et al. | |
| 7,007,455 | B2 | | 3/2006 | Kraft | |
| 7,093,794 | B2 | | 8/2006 | Leyva et al. | |
| 7,100,377 | B2 | | 9/2006 | Kraft | |
| 7,797,110 | B2 | | 9/2010 | Shin | |
| 7,841,982 | B2 | | 11/2010 | Johnson et al. | |
| 7,882,926 | B2 | * | 2/2011 | Fullerton | 181/117 |
| 7,944,774 | B2 | | 5/2011 | Monk et al. | |
| 2005/0103022 | A1 | | 5/2005 | Kraft | |
| 2005/0125933 | A1 | | 6/2005 | Hochstein, Jr. et al. | |
| 2007/0199382 | A1 | | 8/2007 | Sakai | |

FOREIGN PATENT DOCUMENTS

| | | | |
|---|---|---|---|
| GB | 1 269 123 | | 4/1972 |
| JP | 59-56023 | | 4/1984 |
| RU | 2 084 675 | C1 | 7/1997 |
| RU | 2 130 597 | C1 | 5/1999 |
| RU | 2 188 084 | C2 | 8/2002 |
| RU | 36135 | | 2/2004 |
| SU | 1716253 | A1 | 2/1992 |
| WO | WO-94/22559 | | 10/1994 |
| WO | WO-99/09355 | A1 | 2/1999 |

OTHER PUBLICATIONS

International Search Report dated Sep. 10, 2008 issued in PCT/US07/09442.

Kelly, J., "After Combustion: Detonation," Popular Science, Sep. 2003.

Lu, F.K. et al., "Experimental study of a pulse detonation rocket with Shchelkin spiral," Aerodynamics Research Center, University of Texas at Arlington, TX 76019, USA, pp. 1-6, 2007.

Nicholls, J.A. et al., "Intermittent detonation as a thrust-producing mechanism," Engineering Research Institute, University of Michigan, Jan. 1954.

Notification of Transmittal of the International Search Report and the Written Opinion of the International Searching Authority, or The Declaration dated Sep. 10, 2008.

Van Wingerden, K. et al., "Detonations in pipes and in the open," Christian Michelsen Research, Bergen, Norway, Nov. 1999.

Written Opinion of the International Searching Authority dated Apr. 24, 2008, Issued in International Application No. PCT/US2007/09441.

Written Opinion of the International Searching Authority dated Sep. 10, 2008 issued in PCT/US07/09442.

Office Action dated Jul. 27, 2011, issued in related U.S. Appl. No. 11/785,327.

Russian Decision on Grant dated Jun. 15, 2011, issued in related Russian Patent Application No. 2008145048/07(058826), and an English-language translation.

Russian Decision on Grant received Jul. 29, 2011, issued in related Russian Patent Application No. 2008145045/07(058823), and an English-language translation.

Office Action dated Mar. 29, 2010, issued in related U.S. Appl. No. 11/785,320.

International Search Report dated Sep. 10, 2008, issued in related International Appln. No. PCT/US07/09444.

Written Opinion of the International Searching Authority dated Sep. 10, 2008, issued in related International Appln. No. PCT/US07/09444.

* cited by examiner

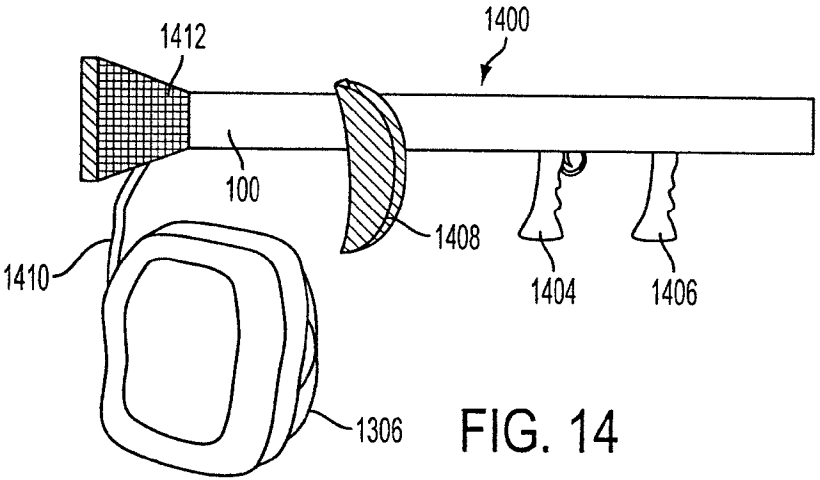
FIG. 14
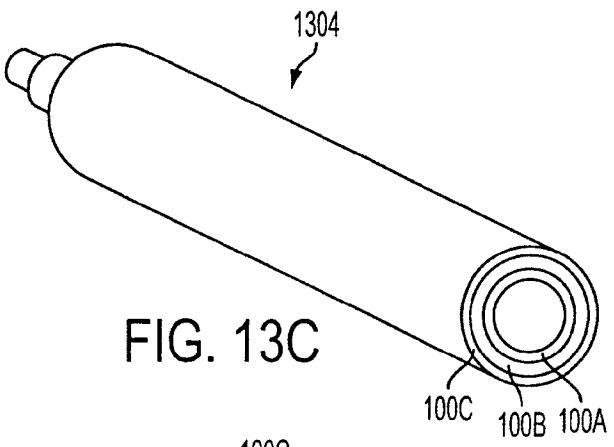
FIG. 13C
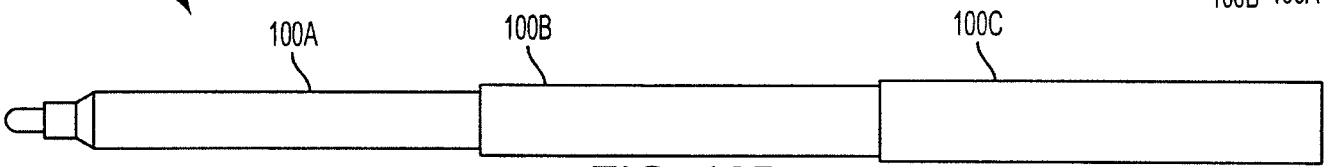
FIG. 13D
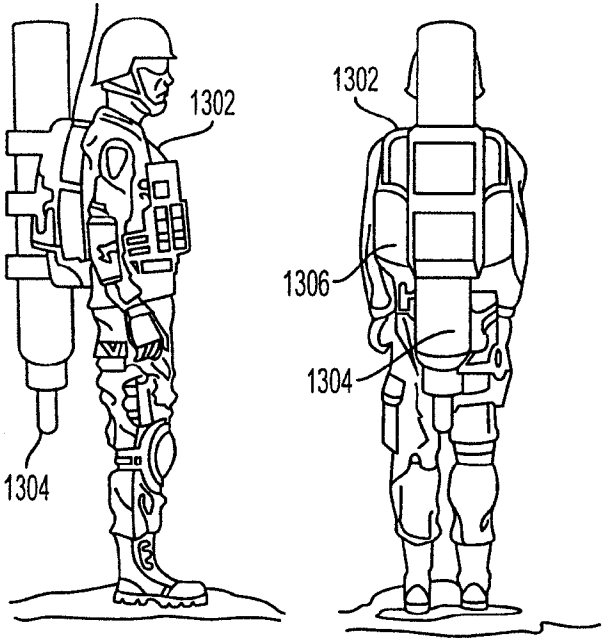
FIG. 13B
FIG. 13A

SYSTEM AND METHOD FOR GENERATING AND DIRECTING VERY LOUD SOUNDS

CROSS REFERENCE TO RELATED APPLICATIONS

This application is a continuation of U.S. patent application Ser. No. 11/785,320 filed on Apr. 17, 2007, entitled "A System and Method for Generating and Directing Very Loud Sounds", which claims priority to U.S. Provisional Patent Application 60/792,420, filed Apr. 17, 2006, and U.S. Provisional Patent Application 60/850,683, filed Oct. 10, 2006. All of the foregoing applications are incorporated herein by reference.

FIELD OF THE INVENTION

The present invention relates generally to a system and method for producing and directing sound loud enough to be used as a weapon. More particularly, the present invention relates to a method of using partially confined gas detonation to produce and direct very loud sound waves toward people, structures or animals for use as a weapon.

BACKGROUND OF THE INVENTION

In the process of conducting warfare in urban settings it is often desired to employ a weapon that causes limited or no damage to people and/or structures. The arsenal available to a typical fighting force however was designed for all out war and as a consequence was designed to produce the maximum lethality and property damage. Ironically it is the extreme lethality of such weapons that puts the US and Coalition warfighters in the greatest danger in an urban setting. While putting an M1A1 round into an apartment building would definitely quiet a sniper, normal hesitation to create high levels of collateral civilian damage and injury increases the chances of friendly casualties and permits possible escape of the perpetuator.

Urban warfare as encountered in both Iraq and Afghanistan is new to the military and must be fought using a new set of rules and new technology that can meet and overcome both today's and tomorrow's asymmetric threats. What is sorely needed is the capability of returning an overwhelming counter force that gives the warfighter the option of not causing permanent injury or severe property damage in urban settings.

US warfighters, to include such agencies as for example SWAT teams, engaged in combat today require lightweight, modular, versatile, and effective multiple-use systems to meet and overcome the growing and evolving challenges and threat posed by asymmetric warfare. New engagement Doctrine and operational practices which are not cumbersome to the soldier need to be employed. A multiple-use system concept is needed that enables the warfighter to apply an overwhelming, ordnance-free force that can most often avoid the consequences of unwanted collateral damage and casualties.

Today's mines are much more lethal and are designed to overcome conventional mine neutralization methods and techniques. Many modern mines contain a "dash pot" on the trigger that requires application of force for a period of time longer than that of an aerial explosion. This change was made to prevent using aerial bursts and line charges to easily clear a mine field. New methods are needed that can apply a force over such a period of time as to overcome this countermeasure thereby allowing a lane to be cleared by detonating mines a safe distance in front of a convoy.

Equally as insidious as mines are Improvised Explosive Devices (IEDs). The well camouflaged, consistently evolving, and highly lethal IEDs used by terrorists and insurgents alike have accounted for the majority civilian and US/Coalition warfighter casualties in the Middle Eastern Theatre of Operations. New technologies and doctrine to counter evolving threats must be rapidly brought to bear and used as a disrupter against these types of threats.

New technologies are also needed for military perimeter defense purposes and for homeland defense of borders, protection of assets such as dams, airports, power facilities, water treatment plants, etc.

Moreover new technologies are needed to combat underwater threats.

SUMMARY OF THE INVENTION

The present invention is an improved system and method for generating, projecting and steering very loud sound pulses to remote targets such as people, animals and structures. These sound levels that can be projected may vary from annoying at the low end, disabling at the mid range and lethal at the high end. They may also be employed against structures to for example break windows, knock down doors or set up resonances within structures to alarm the occupants, to weaken them or to collapse them.

It is possible using this invention to construct weapons of either a fixed level of energy or one that can be adjusted over a range of output levels depending on the immediate needs. It is also possible to use the present invention to generate and direct conducted acoustic purposes into the water, which can be used for underwater imaging and also for defensive purposes.

The present invention provides a system for producing a sound wave having at least one detonation tube apparatus and at least one timing control mechanism. The detonation tube apparatus, at least one detonator, and a fuel mixture supply system. Each detonation tube has a closed end and an open end. Each detonator has at least one spark initiator. The fuel mixture supply subsystem supplies a fuel-oxidant mixture to the at least one detonator that flows through the at least one detonator and into the closed end of the at least one detonation tube and can optionally also supply a fuel-oxidant mixture directly to the at least one detonation tube. The timing control mechanism controls the timing of the at least one spark initiator initiating at least one spark within the at least one detonator while said fuel-oxidant mixture is flowing through the at least one detonator thereby initiating a detonation wave at the closed end of the at least one detonation tube. The detonation wave then propagates the length of the at least one detonation tube and exits the open end of the at least one detonation tube as a sound wave that can be used to incapacitate a person, detonate a mine, or detonate an improvised explosives device.

The fuel-oxidant mixture can have a desired mass ratio of fuel versus oxidant and a desired flow rate selected based on the length and diameter of the at least one detonation tube and the at least one detonator. The spark initiator can be a high voltage pulse source, a triggered spark gap source, a laser, or an exploding wire. The timing control mechanism can be a trigger mechanism, fixed logic, or a control processor. A control processor can be used to control variable parameters of the fuel mixture supply subsystem.

The fuel-oxidant mixture can be gaseous or dispersed and can be methane, propane, hydrogen, butane, alcohol, acetylene, MAPP gas, gasoline, or aviation fuel.

The timing control mechanism can cause a plurality of detonation tubes to produce a plurality of the detonation waves that are timed to direct sound waves to a desired location in order to incapacitate a person, detonate a mine, or detonate an improvised explosives device.

The timing control mechanism can cause a plurality of detonation tube arranged in a sparse array to produce a plurality of the detonation waves that are timed to direct sound waves to a desired location in order to incapacitate a person, detonate a mine, or detonate an improvised explosives device.

The invention can include at least one coupling component corresponding to each at least one detonation tube apparatus that couples the recoil force of the sound wave to water to produce a conducted acoustic wave. A plurality of detonation tube apparatuses arranged in a sparse array, each having a coupling component, can produce a plurality of conducted acoustic waves with controlled timing in order to direct them to a desired location in the water.

The invention can include at least one weapons platform that could be any one of a tripod, a robot, an unmanned ground vehicle, an unmanned aerial vehicle, a HMMV, an armored personnel carrier, a boat, a ship, a helicopter, a tank, an artillery platform, an airplanes, a soldier.

The at least one detonation tube could include a graduating detonation tube combination, a detonation tube group, a compression technique, or an expander technique.

The invention provides a method for producing a sound wave including the steps of supplying a fuel-oxidant mixture to at least one detonator having at least one spark initiator where the fuel-oxidant mixture flows through the at least one detonator and into the closed end of at least one detonation tube also having an open end, and controlling the timing of the at least one spark initiator to initiate at least one spark within the at least one detonator while the fuel-oxidant mixture is flowing through the at least one detonator thereby initiating a detonation wave at the closed end of the at least one detonation tube where the detonation wave propagates the length of the at least one detonation tube and exits the open end of the at least one detonation tube as a sound wave.

The at least one detonation tube could be a plurality of detonation tubes where the controlling of the timing of the at least one spark initiator causes a plurality of sound waves to be directed to a desired location.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 13A depicts a side view of a soldier transporting a directed sound wave weapon as an attachment to his backpack;

FIG. 13B depicts a back view of soldier of FIG. 13A;

FIG. 13C depicts an embodiment of a directed sound wave weapon comprising three detonation tubes of graduating sizes where the smallest diameter tube fits within the next largest diameter tube that fits within the largest diameter tube such that the length of the weapon is reduced to simplify transport by a soldier;

FIG. 13D depicts the embodiment of the directed sound wave weapon of FIG. 13C where the detonation three tubes have been pulled apart such that the directed sound wave weapon comprises a graduated tube combination that can produce a higher magnitude overpressure wave than a shorter tube;

FIG. 14 illustrates a handheld directed sound wave weapon that can be used as both a battering ram and used to direct an overpressure wave at a target;

DETAILED DESCRIPTION OF THE INVENTION

Figure 1A:
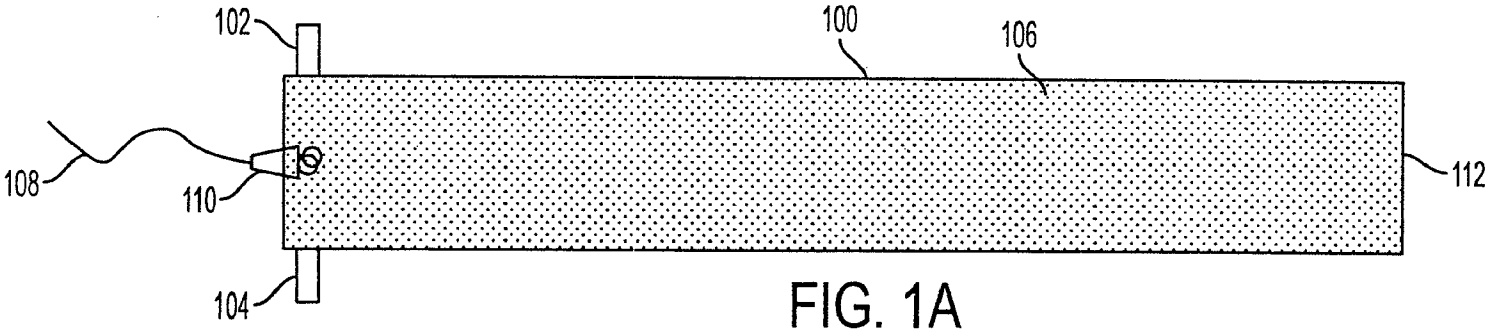
FIG. 1A PRIOR ART
FIG. 1A illustrates an exemplary prior art detonation tube having separate fuel and oxidizer supplies and a spark plug that ignites the fuel mixture at the closed end of the tube after the tube has been filled.

The present invention will now be described more fully in detail with reference to the accompanying drawings, in which the exemplary embodiments of the invention are shown. This invention should not, however, be construed as limited to the embodiments set forth herein; rather, they are provided so that this disclosure will be thorough and complete and will fully convey the scope of the invention to those skilled in the art. Like numbers refer to like elements throughout.

The present invention provides an improved system and method for generating and controlling an overpressure wave, which is also be referred to herein as a sound wave or sound pulse. Exemplary overpressure waves can be characterized by their frequency in the range of 0.1 Hz to 30 KHz. The basis of the system is the ignition of a high energy, detonable gaseous or dispersed fuel-air or fuel-oxygen mixture within a tube that is open at one end, where any of a number of flammable fuels can be used including ethane, methane, propane, hydrogen, butane, alcohol, acetylene, MAPP gas, gasoline, and aviation fuel. The gas mixture is detonated at the closed end of the tube causing a detonation wave to propagate the length of the tube where detonation ends and the detonation wave exits the open end of the tube as an overpressure wave. The tube is referred to herein as a detonation tube and the detonation wave is referred to herein as a detonation pulse or impulse.

One embodiment of the present invention comprises at least one detonation tube apparatus and a timing control mechanism for controlling the timing of detonations. The detonation tube apparatus comprises at least one detonation tube, at least one detonator, and a fuel-oxidant mixture supply subsystem. One or more detonators can be used with a given detonation tube and a detonator can be used with multiple detonation tubes. Associated with the one or more detonators is one or more spark initiators where a single spark initiator may initiate sparks in multiple detonators, which may be in parallel or in series, and multiple spark initiators may initiate sparks in a single detonator. The timing control mechanism controls the timing of the one or more spark initiators.

The spark initiator may be a high voltage pulse source. As an alternative to the high voltage pulse source a triggered spark gap approach can be used a spark initiator. Other alternatives for a spark initiator include a laser and an exploding wire.

The timing control mechanism can be a simple trigger mechanism, fixed logic, or be a more complex control processor. A control processor may also be used to control variable parameters of the fuel-oxidant mixture supply subsystem or such parameters may be fixed.

The fuel-oxidant mixture supply subsystem maintains a desired mass ratio of fuel versus oxidant of the fuel-oxidant mixture and a desired flow rate of the fuel-oxidant mixture. Desired fuel versus oxidant ratio and flow rate can be selected to achieve desired detonation characteristics that depend on length and diameter characteristics of the detonator. For example, one embodiment uses a propane-air fuel-oxidant mixture, a mass ratio of 5.5 and a flow rate of 50 liters/minute for a detonator having a length of 1" and a ¼" diameter and made of Teflon, a first detonation tube made of stainless steel having a length of 9" and a diameter that tapers from 0.8" at the end connected to the detonator to 0.65" at the end connected to a second detonation tube made of titanium having a length of 32" and a 3" diameter. Alternatively, the first detonation tube may have a constant diameter of 0.8".

Commercially available mass flow control valve technology can be used to control the mass ratio of fuel versus oxidant of the fuel-oxidant mixture and the flow rate of the fuel-oxidant mixture. Alternatively, commercially available technology can be used to measure the mass flow of oxidant into a fuel-oxidant mixture mixing apparatus and the precise oxidant mass flow measurement can be used to control a mass flow valve to regulate the mass flow of the fuel needed to achieve a desired mass ratio of fuel versus oxidant of the fuel-oxidant mixture.

Detonation within Flowing Fuel-Oxidant Mixture

Prior art gas detonation systems either required long tubes or highly detonable gas mixtures such as oxygen and hydrogen in order to produce a detonation. Otherwise they will only "deflagrate" which is a slow and nearly silent process. In contrast, one aspect of the present invention provides the ability to produce short, high intensity sound pulses within a tube as short as one foot long and 2 inches diameter, using only moderately explosive gas mixtures such as propane and air. Unlike the prior art systems, this aspect of the present invention is embodied in an exemplary system that passes an electric arc through a flowing (or moving) stream of gas and oxidizer mixture that is filling the tube within which the detonation will take place. When the tube is substantially full, a fast spark is initiated within the flowing gas at the filling point in the tube, which triggers the subsequent detonation of all the gas inside the tube. Alternatively, the flowing gas can be detonated by a laser or by any other suitable ignition and detonation method according to the present invention. This ignition within flowing gas technique dramatically shortens the tube length required to produce a detonation when compared to prior art systems that ignited non-flowing or otherwise still gas mixtures. Moreover, detonation according to this aspect of the present invention requires on the order of 1 Joule of energy to detonate the fuel-oxidant mixture whereas prior art systems may require 100's to 1000's of Joules of energy to achieve detonation. Further desirable results of this method are the reduction of uncertainty of time between the electric arc trigger and the subsequent emission of the sound pulse from the tube and the repeatability of detonation pulse magnitude. As such, the detonator according to this aspect of the present invention enables precise timing and magnitude control of an overpressure wave.

Figure 1B:
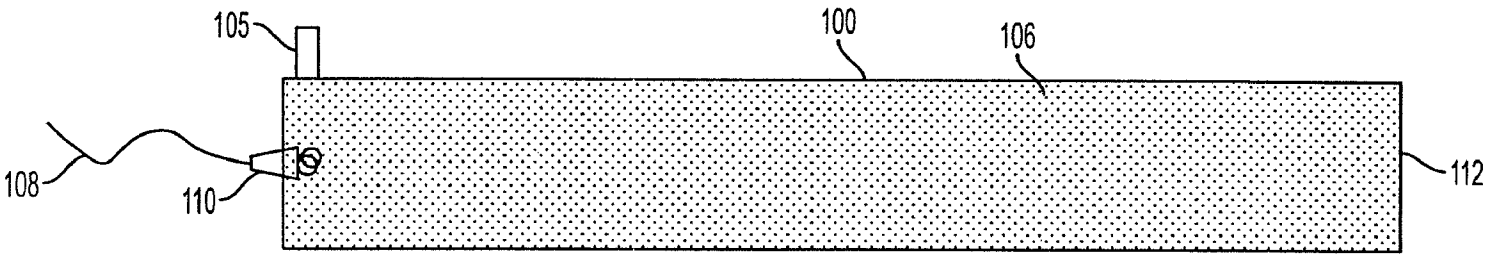
FIG. 1B PRIOR ART
FIG. 1B illustrates a second exemplary prior art detonation tube having a fuel mixture supply and a spark plug that ignites the fuel mixture at the closed end of the tube after the tube has been filled.

FIG. 1A depicts a side view of a prior art detonation system. A detonation tube 100 has separate fuel supply 102 and oxidizer supply 104 which are opened during a fill period to fill detonation tube 100 with fuel-oxidant mixture 106. After the fill period, fuel supply 102 and oxidizer supply 104 are closed and at a desired time a charge is applied through high voltage wire 108 to spark plug 110, which ignites the fuel-oxidant mixture 106 causing a detonation wave to propagate down the length of the detonation tube 100 and exit its open end 112. Similarly, FIG. 1B depicts a side view of another prior art detonation system where detonation tube 100 has a fuel-oxidant mixture supply 105 which is opened during a fill period to fill detonation tube 100 with fuel-oxidant mixture 106. After the fill period, fuel-oxidant mixture supply 105 is closed and at a desired time a charge is applied through high voltage wire 108 to spark plug 110, which ignites the fuel-oxidant mixture 106 causing a detonation wave to propagate down the length of the detonation tube 100 and exit its open end 112.

Figure 2A:
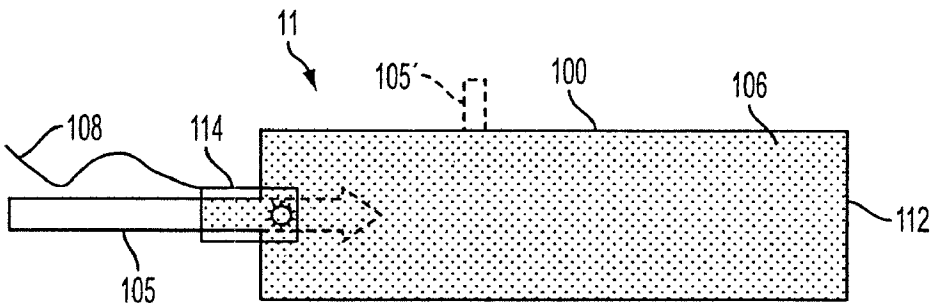
FIG. 2A illustrates an exemplary detonation tube of the present invention having a detonator that receives a fuel mixture from a fuel mixture supply and ignites the fuel mixture as it is flowing into the tube.

FIG. 2A depicts the detonation tube 100 of the overpressure wave generator 11 of the present invention being supplied by fuel-oxidant mixture supply 105 via detonator 114, where a spark ignites within the fuel-oxidant mixture 106 while the detonation tube 100 is being filed with the fuel-oxidant mixture 106 causing a detonation wave to propagate down the length of the detonation tube 100 and exit its open end 112. In one embodiment, an appropriate fuel-oxidant mixture flow rate is maintained during ignition within the flowing fuel-oxidant mixture. It has been found that over a substantial range of flows the higher the flow rate the more rapid the evolution of the detonation wave. Hence, one exemplary embodiment uses a high flow rate. For a given spark energy, a certain flow rate defines the practical upper limit of flow rate. In one embodiment, the tubing that feeds the detonation tube is below a critical radius to prevent the detonation progressing back to the fuel supply. For example, one embodiment use ¼" diameter tubing to prevent such flashback and yet presents a low resistance to gas flow. For example, a 1" long detonator having a ¼" diameter bore hole can achieve detonation using a 1 joule spark within a MAPP gas-air mixture flowing at 50 liters/minute.

Also shown in FIG. 2A is an optional secondary fuel-oxidant mixture supply 105'. One or more secondary fuel-oxidant mixture supplies 105' can be used to speed up the filling of a large detonation tube (or tube combination). With one approach, one or more secondary fuel-oxidant mixture supplies 105' are used to speed up filling of a detonation tube 100 in parallel with the (primary) fuel-oxidant mixture supply 105 such that detonator 114 can ignite the flowing fuel-oxidant mixture at a desired flow rate. With another approach, fuel-oxidant mixture supply 105 may supply the detonation tube at a first higher rate and then change to a second rate prior to the flowing fuel-oxidant mixture being ignited. In still another approach, secondary fuel-oxidant mixture supply 105' supplies a different fuel-oxidant mixture 106' (not shown in FIG. 2A) into detonation tube 100 than the fuel-oxidant mixture 106 supplied by fuel-oxidant mixture supply 105 into detonator 114.

For certain fuels it may be necessary to heat the fuel-oxidant mixture in order to achieve detonation. Depending on the rate at which the detonation tube is fired, it may be necessary to cool the detonation tube. Under one preferred embodiment of the invention, fuel supply 105 (and/or 105') comprises at least one heat exchange apparatus (not shown) in contact with the detonation tube that serves to transfer heat from the detonation tube to the fuel-oxidant mixture. A heat exchange apparatus can take any of various well known forms such as small tubing that spirals around the detonation tube from one end to the other where the tightness of the spiral may be constant or may vary over the length of the detonation tube. Another exemplary heat exchanger approach is for the detonation tube to be encompassed by a containment vessel such that fuel-oxidant mixture within the containment vessel that is in contact with the detonation tube absorbs heat from the detonation tube. Alternatively, a heat exchanger apparatus may be used that is independent of fuel supply 105 in which case some substance other than the fuel-oxidant mixture, for example a liquid such as water or silicon, can be used to absorb heat from the detonation tube. Alternatively, another source of heat may be used to heat the fuel-oxidant mixture. Generally, various well known techniques can be used to cool the detonation tube and/or to heat the fuel-oxidant mixture including methods that transfer heat from the detonation tube to the fuel-oxidant mixture.

Figure 2B:
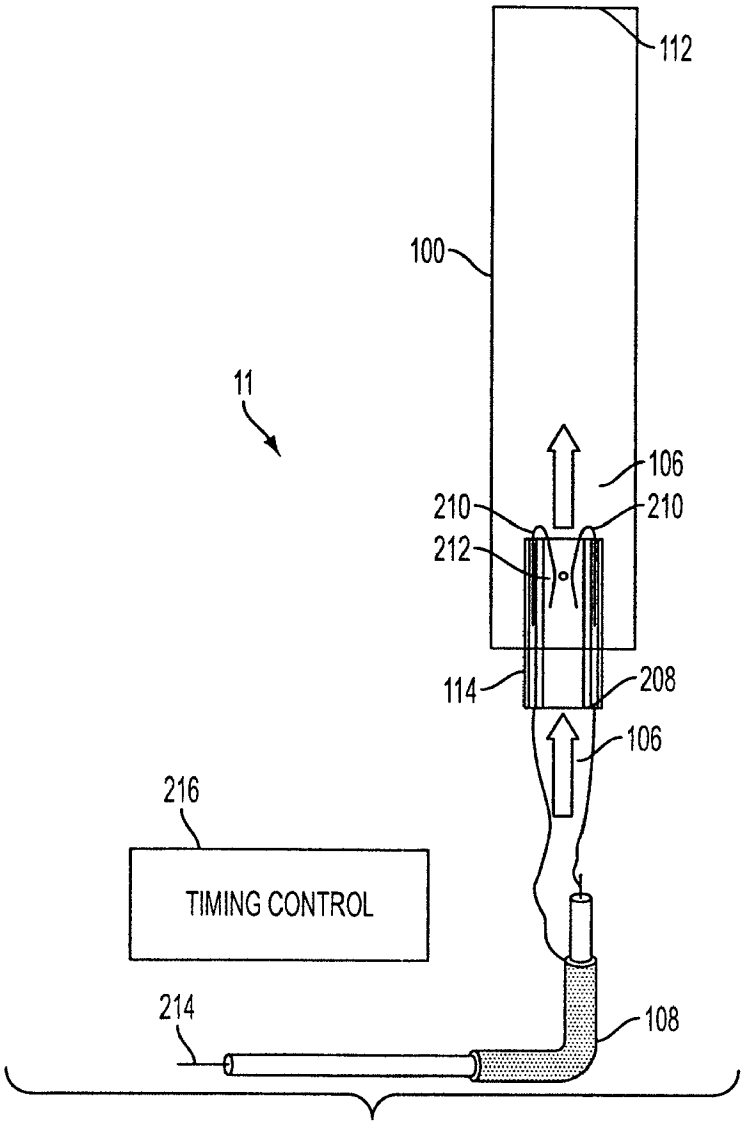
FIG. 2B depicts a first embodiment of the detonator of the present invention that functions by creating an electrical arc within a stream of a gas mixture.

FIG. 2B depicts a first embodiment of the detonator of the present invention that functions by creating an electrical arc within a stream of a detonatable gas mixture. As shown in FIG. 2B, a gas mixture 106 of a combustible gas and oxidizer in the correct detonable ratio is passed into a detonation tube 100 via fill point 208 of detonator 114. When the tube is substantially full, high voltage wire 108 is triggered at high voltage trigger input 214 to cause a spark 212 to occur across bare wires 210 and to pass through the gas mixture 106 flowing into the detonation tube 100 to initiate detonation of the gas in the detonation tube 100. Triggering of high voltage trigger is controlled by timing control mechanism 216.

Figure 2C:
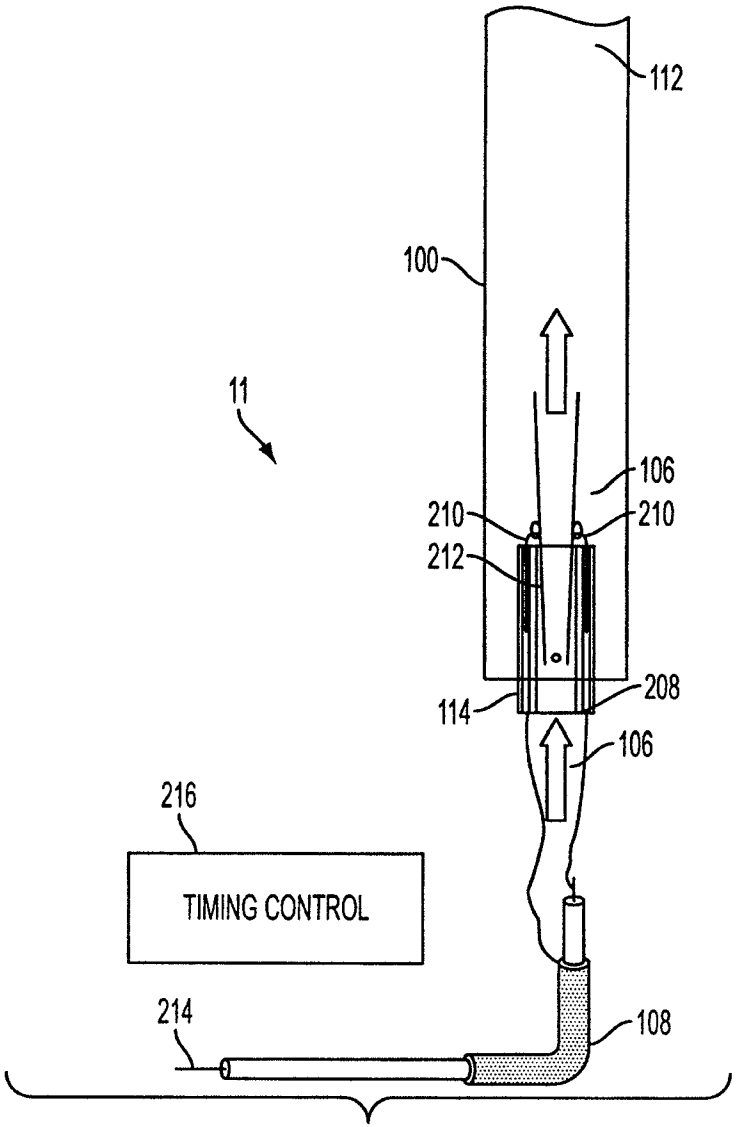
FIG. 2C depicts a second embodiment of the detonator of the present invention is similar to that depicted in FIG. 2B except it includes two conductors that diverge into the main tube causing the length of the spark to increase as it travels into the main detonation tube.

FIG. 2C depicts a second embodiment of the detonator of the present invention that also functions by creating an electrical arc within a stream of a detonatable gas mixture. As shown in FIG. 2C, a gas mixture 106 of a combustible gas and oxidizer in the correct detonable ratio is passed into a detonation tube 100 via fill point 208 of detonator 114. When the tube is substantially full, high voltage wire 108 is triggered at high voltage trigger input 214 to cause a spark 212 to occur across bare wires 210 and to pass through the gas mixture 106 flowing into the detonation tube 100 to initiate detonation of the gas in the detonation tube 100. In this variation the spark is initiated within detonator 114 and then it is quickly swept along the two diverging conductors into the detonation tube 100 by the flowing gas, the length of the spark increasing as it travels into the detonation tube 100. When a spark is initiated in a small gap it creates a stable low impedance zone that is capable of conducting the same voltage electricity across a much larger gap. Alternatively, the wires 210 may be parallel but bent slightly closer together to ensure that the spark starts inside detonator 114.

Figure 3B:
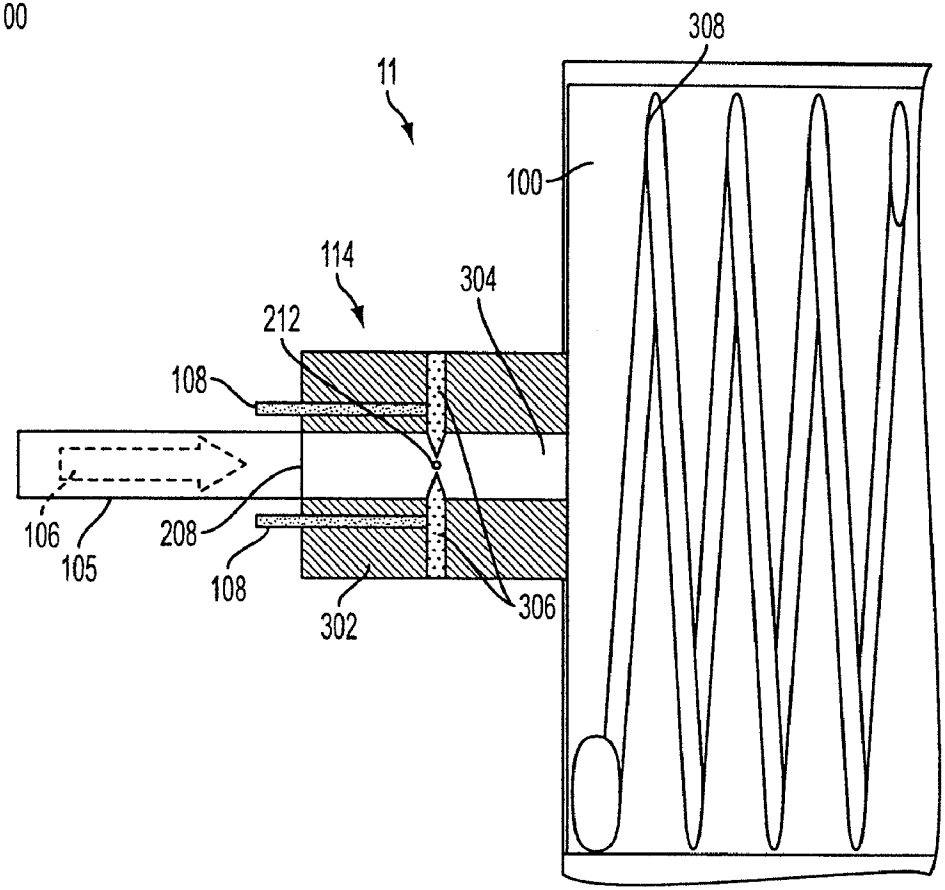
FIG. 3B depicts a side view of a preferred embodiment of the detonator of the present invention.
Figure 3A:
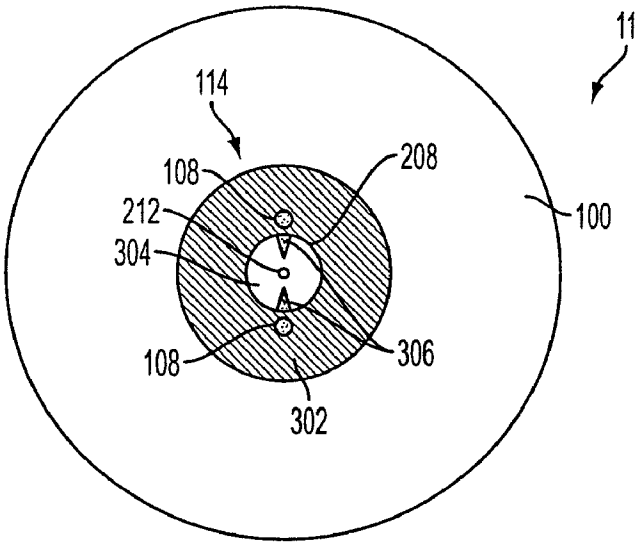
FIG. 3A depicts an end view of a preferred embodiment of the detonator of the present invention.

FIGS. 3A and 3B provide end and side views of an exemplary embodiment of the overpressure wave generator 11 of the present invention. As shown in FIGS. 3A and 3B, detonator 114 comprises insulating cylinder 302 surrounding detonator tube 304. Electrodes 306 are inserted from the sides of insulating cylinder 302 and are connected to high voltage wire 108. The detonator tube 304 is connected to fuel-oxidant mixture supply 105 (shown in FIG. 3B) at fill point 208 and to detonation tube 100 at its opposite end. As shown in FIG. 3B, a gas mixture 106 is passed into the detonation tube 304 and then into detonation tube 100 via fill point 208 of detonator 114. When detonation tube 100 is essentially full, high voltage wire 108 is triggered to cause a spark 212 to occur across electrodes 306 and to pass through the gas mixture 106 flowing into detonator tube 304 to initiate detonation of the gas in detonation tube 100. Also shown in FIG. 3B is a Shchelkin spiral 308 just inside the closed end of detonation tube 100. The Shchelkin spiral 308 is well known in the art as a deflagration-to-detonation transition (DDT) enhancement device. In one exemplary embodiment of the invention the Shchelkin spiral 308 has 10 turns, is 7" long, and is constructed using #4 copper wire that is tightly wound against the inside of the detonation tube 100 at its base (closed end).

Overpressure Wave Magnitude Control

Generally, the length and inside diameter of a detonation tube can be selected to achieve a desired maximum generated overpressure wave magnitude at a maximum selected flow rate of a selected flowing fuel-oxidant mixture, and the flow rate can be reduced to lower the magnitude of the generated overpressure wave. If required, increasingly larger tubes can be used to amplify the detonation pulse initially produced in a smaller detonation tube. Each one or a plurality of the tubes can be made of one or a combination of materials and allows, including PVC or a variety of different compounds, metals, or even concrete to achieve a desired result. In one exemplary embodiment the detonation tube is made of titanium. In an exemplary embodiment, the detonator within which the spark is introduced has a small diameter, e.g. approximately ¼" diameter. This assembly is aligned to the base of a second larger detonation tube so that the gas contained within it is detonated. This second detonation tube may then be aligned to the base of a successively larger diameter tube to initiate detonation of the gas mixture within. In this way, very large diameter detonation tube detonations may be initiated with precise timing accuracy.

Figure 4:
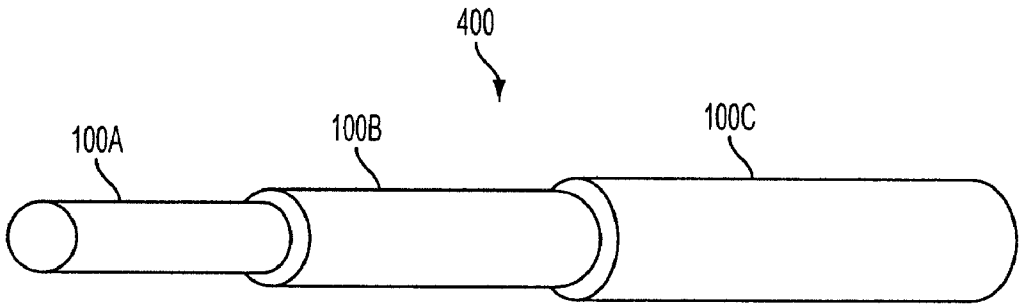
FIG. 4 depicts an exemplary graduating detonation tube combination whereby larger and larger diameter tubes are used in combination to amplify a detonation wave.

The use of tubes having increasingly larger diameters is shown in FIG. 4 which illustrates a graduating detonation tube combination 400 comprising increasingly larger detonation tubes that amplify a detonation pulse. A detonation pulse produced in an initial detonation tube 100A travels through detonation tubes 100B and 100C having larger diameters. Generally, as the detonation of the gas mixture transitions from a detonation tube having a smaller diameter to a detonation tube having a larger diameter the size of the pulse is amplified. In accordance with the invention one or more detonation tubes having different diameters can be combined into a graduating detonation tube combination 400.

Figure 5:
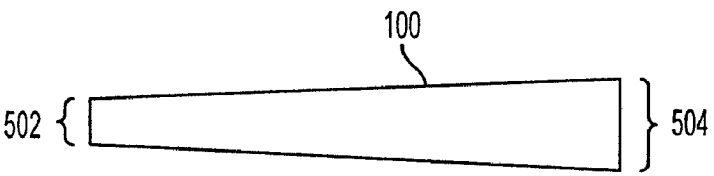
FIG. 5 depicts an exemplary detonation tube having a diameter that increases across the length of the tube that amplifies a detonation wave.
Figure 6:
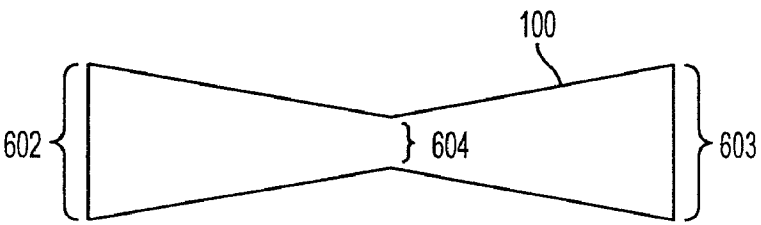
FIG. 6 illustrates a tube having a gradually shrinking and then gradually enlarging tube circumference.

In the exemplary embodiment described above, the detonation tube (and the detonator tube) was assumed to be a tube having a circumference that does not vary over the length of the tube. As an alternative, a detonation tube (or detonator tube) may begin with a small diameter and gradually grow larger in order to have a similar effect of amplifying the pulse as described for FIG. 4. One exemplary approach is shown in FIG. 5 which depicts a side view of a detonation tube 100 having a gradually enlarging diameter. The diameter of a detonation tube becoming larger and larger causes the pulse to be amplified as it travels the length of the tube in a manner similar to the graduated tube technique of FIG. 4. As shown, detonation tube 100 has a first diameter 502 at one end that is smaller than second diameter 504 at the other end. Multiple tubes having enlarging diameters can also be combined. Another variation of the detonation tube is to use a compressor/expander technique where the circumference of the tube tapers to a smaller circumference to compress the gas and then expands to a larger circumference to expand the gas. This approach is shown in FIG. 6 which depicts a side view of detonation tube 100 based on the compressor/expander technique that has a first diameter 602 at one end, a second diameter 603 at the other end and a third diameter 604 between the two ends of the detonation tube 100. The first diameter 602 may or may not equal second diameter 603 depending on desired compression/expansion characteristics.

Detonation Tube Arrays

Figure 7A:
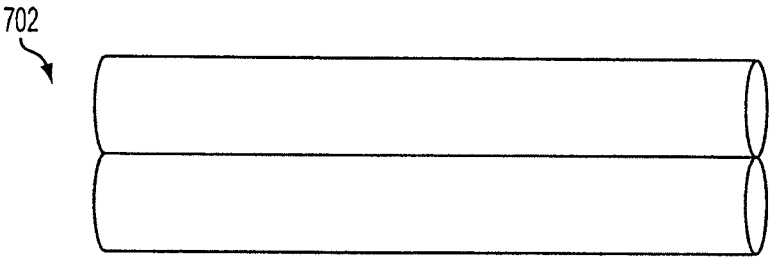
FIG. 7A depicts a first detonation tube alongside a second detonation tube.
Figure 7B:
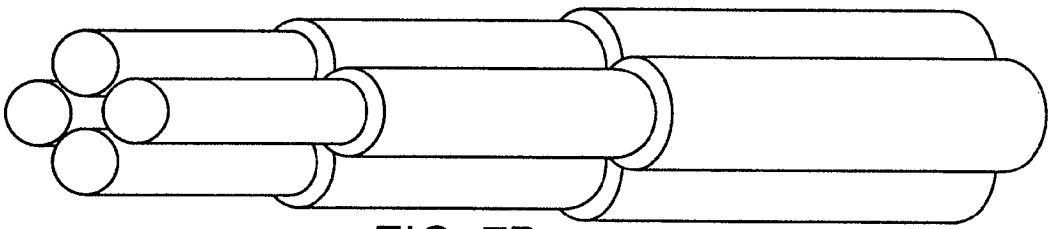
FIG. 7B depicts four detonation tube combinations arranged such that the larger detonations tubes of the detonation tube combinations are in contact with each other.
Figure 7C:
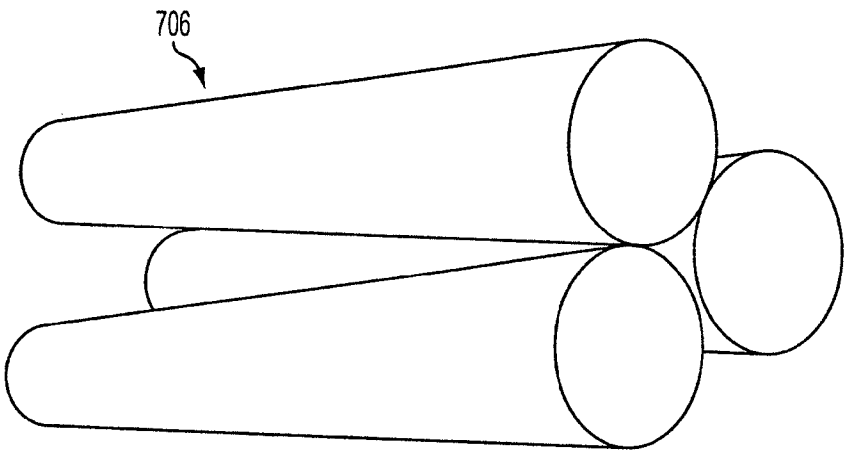
FIG. 7C depicts three enlarging diameter detonation tubes.
Figure 7D:
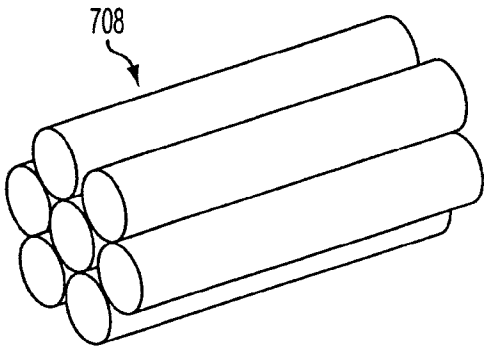
FIG. 7D depicts seven detonation tubes arranged to resemble a hexagonal structure.
Figure 7E:
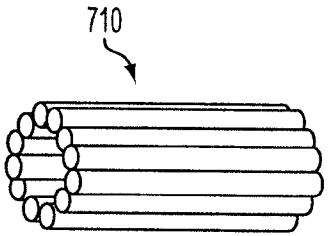
FIG. 7E depicts twelve detonation tubes arranged in a circular manner.

Detonation tubes can be grouped into arrays in various ways to produce a combined pulse when triggered simultaneously. FIGS. 7A-7D depict examples of how detonation tubes can be combined. FIG. 7A depicts a detonation tube array 702 comprising a first detonation tube alongside a second detonation tube. FIG. 7B depicts a detonation tube array 704 comprising four detonation tube combinations arranged such that the larger detonations tubes of the detonation tube combinations are in contact with each other. FIG. 7C depicts detonation tube array 706 comprising three enlarging diameter detonation tubes. FIG. 7D depicts detonation tube array 708 comprising seven detonation tubes arranged to resemble a hexagonal structure. FIG. 7E depicts detonation tube array 710 comprising twelve detonation tubes arranged in a circular manner.

Alternatively, the detonation tubes that make up such detonation tube groups or arrays can also be triggered at different times. Under one arrangement, detonation tubes are ignited using a timing sequence that causes them to detonate in succession such that a given detonation tube is being filled with its fuel-oxidant mixture while other detonation tubes are in various states of generating an overpressure wave. With this approach, the igniting and filling of the detonation tubes could be timed such that overpressure waves are being generated by the apparatus at such a high rate that it would appear to be continuous detonation.

Figure 8:
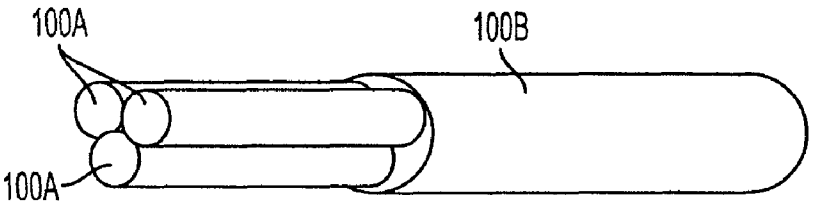
FIG. 8 depicts a side view of three detonation tubes having a first diameter connected to a larger detonation tube having a second larger diameter to amplify the combined pulse generated by the smaller tubes.

As shown in FIG. 8, a group of smaller tubes can be connected to a larger tube such that their combined pulses produce a large pulse that continues to detonate in the larger tube. FIG. 8 depicts a side view of 3 smaller detonation tubes 100A having a first diameter connected to a larger detonation tube 100B having a second larger diameter to amplify a combined pulse.

Generally, any of various possible combinations of graduated tubes, tubes of gradually increasing circumferences, tube arrays, groups of smaller tubes connected to larger tubes, and tubes employing the compressor/expander technique can be used in accordance with this aspect of the invention to generate overpressure waves that meet specific application requirements. All such combinations require balancing the energy potential created due to an expansion of a pipe circumference with the cooling caused by expansion of the gases as the tube circumference increases.

Coherent Focusing and Steering of Overpressure Waves

As described previously, the detonator of this aspect of the present invention has low uncertainty of time between the electric arc trigger and the subsequent emission of the sound pulse from the tube. The detonator also provides for repeatable precision control of the magnitude of the generated sound pulses. This low uncertainty, or jitter, and precision magnitude control enables the coherent focusing and steering of the overpressure waves generated by an array of detonation tubes. As such, the detonator can be used to generate steerable, focusable, high peak pulse power overpressure waves.

Figure 9:
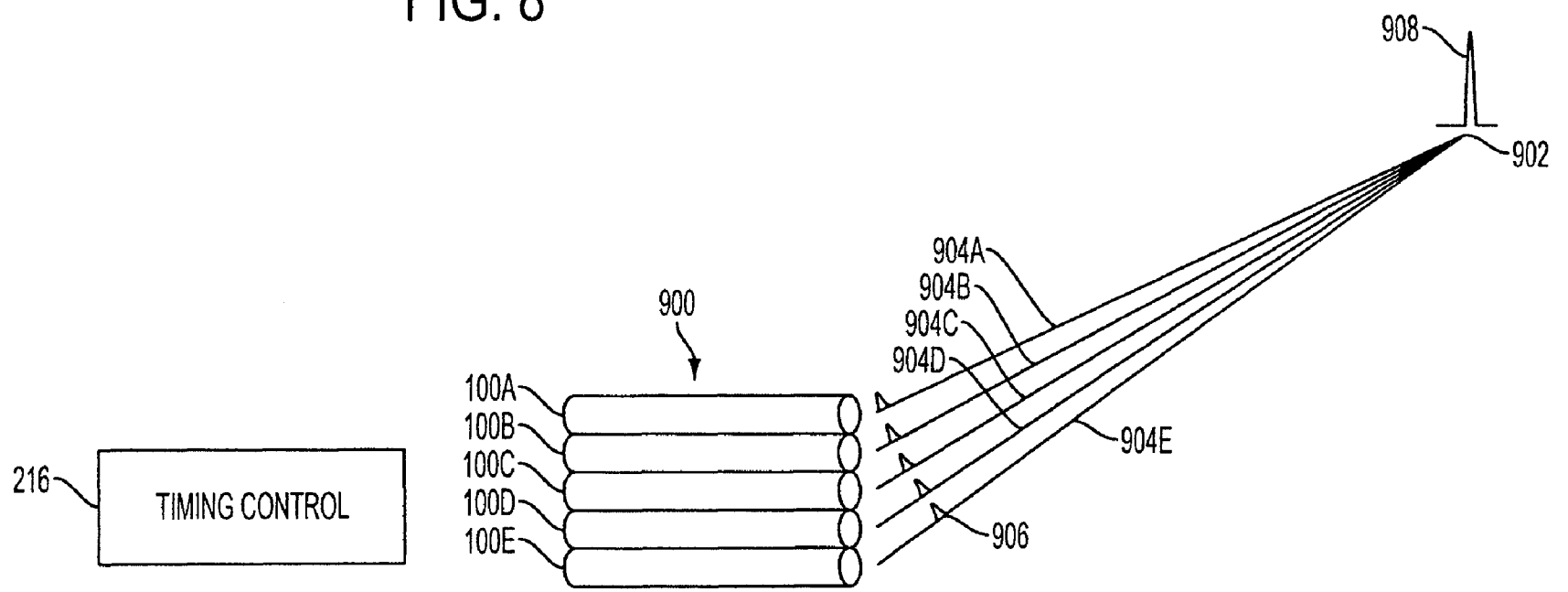
FIG. 9 provides an illustration of how the timing of the firing of individual detonation tubes focuses the power at a single point in the far field.

FIG. 9 illustrates how the timing of the firing of individual tubes focuses the power of the generated overpressure waves at a single point in the far field. Tubes further away are triggered earlier to compensate for the greater amount of time required to travel a greater distance which causes all the pulses to arrive at the same point in space at the same time. FIG. 9 depicts an array 900 of detonation tubes 100A-100E that are ignited (or fired) with controlled timing as controlled by timing control mechanism 216 such that the sound pulses they generate arrive at point in space 902 at the same time. The sound pulses 906 produced by detonation tubes 100A-100E travel along direct paths 904A-904E, respectively. As such, they are fired in sequence 100E-100A with appropriate delays between firings to account for different times of travel required to travel the different direct paths so that the sound pulses 906 arrive at point in space 902 at the same time to produce combined sound pulse 908.

Figure 10:
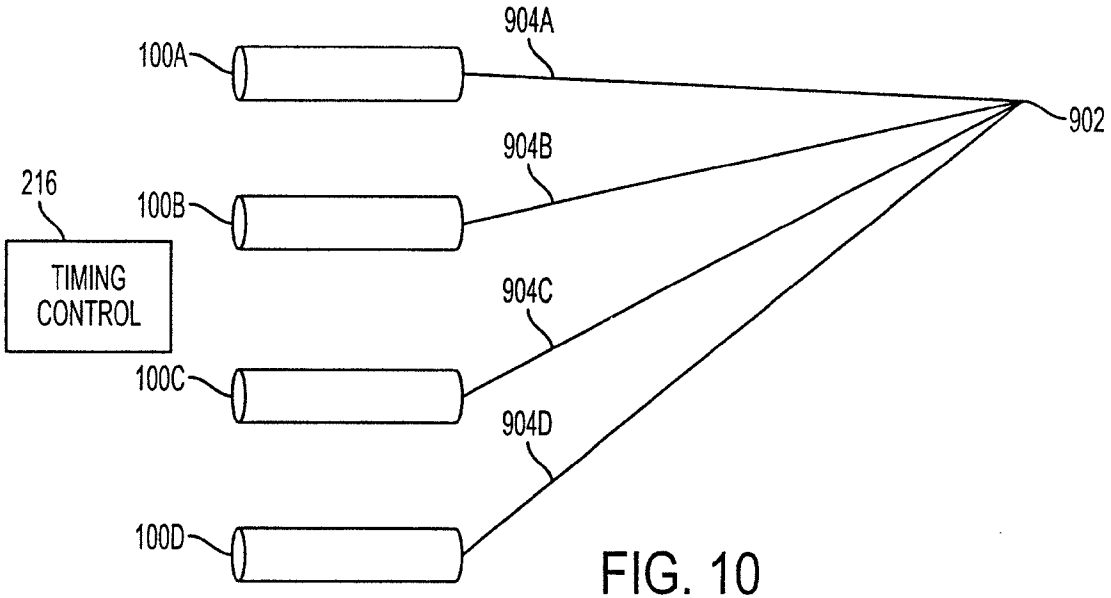
FIG. 10 depicts a sparse array of 4 detonation tubes being detonated so as to steer the overpressure waves such that they combine at a desired location.
Figure 11:
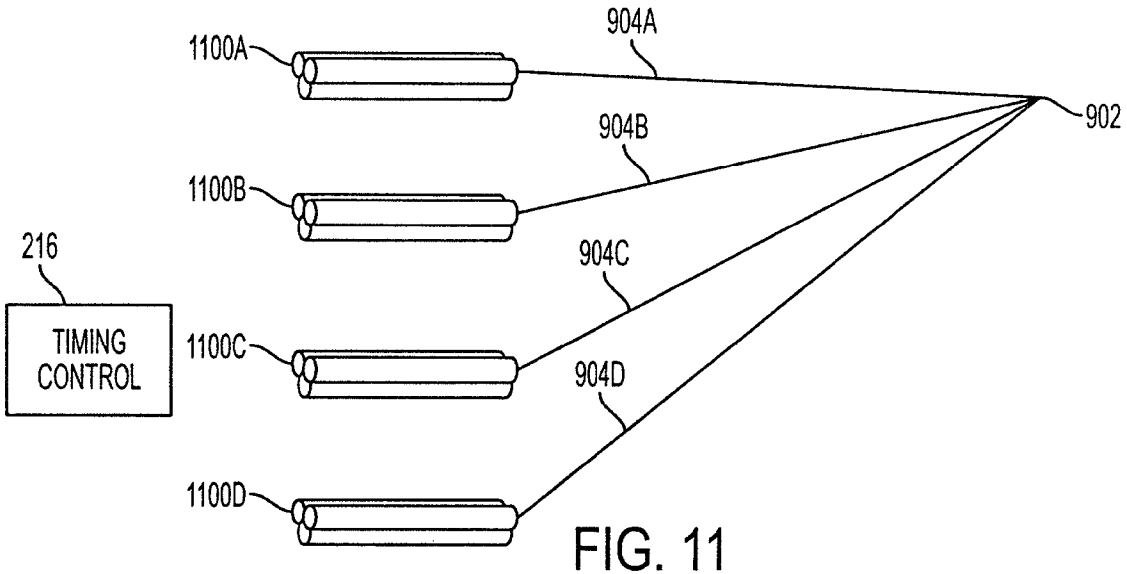
FIG. 11 depicts a sparse array of 4 groups of detonation tubes being detonated so as to steer the overpressure waves such that they combine at a desired location.

Individual detonation tubes or groups of tubes can be arranged in a sparse array. FIG. 10 depicts an array of individual detonation tubes arranged in a sparse array where the timing of the detonations in the various tubes is controlled so as to steer the overpressure waves such that they combine at a desired location. FIG. 11 similarly depicts an array of groups of tubes arranged in a sparse array where the tubes of a given group are detonated at the same time but the detonation timing of the various groups is varied so as to steer the overpressure waves so they combine at a desired location.

Referring to FIG. 10, detonation tubes 100A-100D are fired in reverse sequence with precise timing as controlled by timing control mechanism 216 such that sound pulses travel direct paths 904A-904D and combine at point in space 902. Referring to FIG. 11, detonation tube groups 1100A-1100D are fired in reverse sequence as controlled by timing control mechanism 216 such that sound pulses travel direct paths 904A-904D and combine at point in space 902.

The timing control mechanism 216 used in sparse array embodiments may comprise a single timing control mechanism in communication with each of the overpressure wave generators making up the array via a wired or wireless network. Alternatively, each of the overpressure wave generators may have its own timing control mechanism whereby the timing control mechanisms have been synchronized by some means.

Theory of Operation of Detonation Tube Arrays

Generally, when an array of detonation tubes is triggered with precise timing a pressure wave is created that propagates as a narrow beam in a direction mandated by the timing. In this way its operation is analogous to a phased array antenna commonly used in radar systems. Since the timing is determined electrically the beam direction can be redirected from one pulse to the next. Systems can be designed that operate at different rates, for example 10, 20, 50 or 100 pulses per second, and each pulse can be aimed in a unique direction. The only limitation to repetition rate is the speed with which the tubes can be refilled. At a sonic refill rate it would take about five milliseconds to refill a tube five feet long. Since it also takes a pulse five milliseconds to exit once detonated, the limiting repetition rate is 100 Hz.

Since each element of the array emits its own coherent energy, in the far field the amplitude of the wave approaches the square of the intensity of each individual tube. The instantaneous over pressures that can be directed in this way therefore may approach high levels. As such, the system possesses a large overhead dynamic range that can be used to reach a long range or propagate through small apertures in structures such as hard targets.

The structure behind the small aperture can be resonated by application of the pulses at just the right time intervals, as determined by a probe laser used to measure the Doppler shift of particles at the opening. The natural frequency of the structure can thereby be determined and thereafter the laser is used in closed loop mode to control the timing of the system to produce maximum effect. The instantaneous pressures inside such a hard target can be quite large since the acoustic Q is high. For example, for a Q of only 10 the peak pressure could approach 1000 psi.

Figure 12:
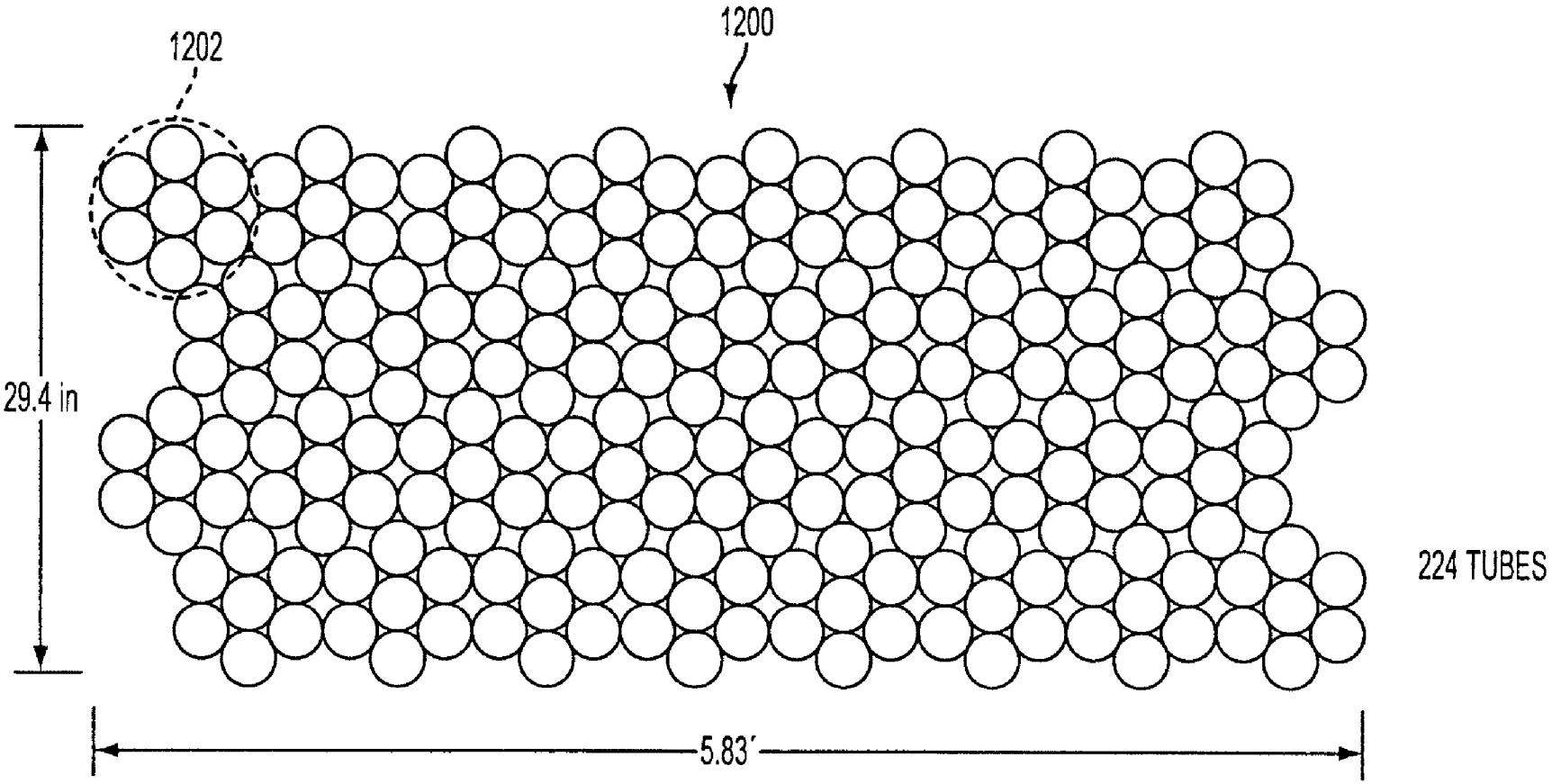
FIG. 12 illustrates an example of efficient packing of hexagonal sub-arrays of 7 detonation tubes into a combined array totaling 224 detonation tubes.

Groups of detonation tubes can be treated as sub-arrays within a larger array. FIG. 12 illustrates an exemplary embodiment of 32 hexagonal sub-arrays 1202 of 7 detonation tubes each efficiently packed into an array 1200 having a total of 224 3" diameter detonation tubes in a 6.2'×2.5' format. The far field intensity of this system can be over 50,000 times the intensity of one such 3" detonation tube.

Timing of the firing of the array elements of this embodiment is straightforward. The waveform is about one millisecond long and the constraint for coherence is ¼ of its wavelength or less. The timing subsystem therefore will need a resolution and accuracy of 200 microseconds or less. This level of timing accuracy can be accomplished with programmable counter-timers such as Intel's 8254 PCA that provides three channels of timing per chip, at a resolution of 0.1 microsecond.

In one embodiment, each element in a steerable array needs to have its energy spread over the entire area of steerability, for example, with an aperture that has under ½ wavelength. For a one millisecond waveform the aperture is about six inches. In the exemplary embodiment shown in FIG. 12, the hexagonal sub-array bundles are nine inches across so they will not allow steering over a full half hemisphere but grouping the tubes into the hexagonal bundles that are fired as a group reduces the hardware requirements allowing thirty two programmable timing channels are used to focus and steer the array. As such, all timing needs can be met with only eleven 8254's. A PCI board made by SuperLogics contains four 8254's giving twelve programmable counter-timers so three modules would suffice. In another embodiment, the tubes of each buddle in FIG. 12 could be spaced apart sufficiently to enable steering over a full half hemisphere and the firing of all the tubes could be independent, without grouping.

The focal spot of the array is a function of the wavelength and the size of the array. Near the array face the focal spot comprises an approximate circle one wavelength, i.e. one foot in diameter. At greater distances the spot will gradually spread out in an oval shape with its large diameter in the direction of the small diameter of the array. That is, the oval becomes vertical for the horizontal array depicted in FIG. 12. The shape of the focal spot can be easily modeled using the wave equation when it is operated in the linear regime up to about half an atmosphere or 7 psi. However when the instantaneous pressure in the waveform approaches an atmosphere it will be non-linear and the calculation differs.

Measurements of the pressure output of the array can be made with a wide band acoustic sensor. They typically have a bandwidth of 10-20,000 Hz and an accuracy of 1 dB or so. Measurements made at a distance of thirty feet or more in the far field of the array give accuracies sufficient to extrapolate characteristics at any range. The calibrated output of such an instrument is acoustic sound pressure level which has a direct relationship to pressure, $$\text{i.e. } L_p(dBSPL) = 10 \cdot \log_{10} \frac{p}{p_0}.$$

For example, 180 dBSPL is equivalent to a pressure of 20,000 Pa or about 3 psi. The instantaneous sound intensity associated with this level is 1,000,000 W/m$^2$.

A consequence of the general wave equation for linear media is that when waves superimpose their amplitudes add. For electromagnetic waves this means that if two identical waves arrive at a point in space at the same time and phase they will produce double the potential, or voltage of a single wave.

The result is similar in the case of acoustic waves but in this case the potential is pressure rather than voltage.

$$p=\sqrt{p_1^2+p_2^2+2p_1p_2\cos(\theta_1-\theta_2)}\,\text{N/m}^2$$

Note that since the phases are equal the cosine is equal to 1 and the value of the pressure is equal to twice the pressure of a single source. This relation applies for the addition of N sources=N*p.

Doubling the pressure of an acoustic waveform quadruples its power since power is proportional to the square of its pressure, namely, when two identical acoustic waveforms arrive at the same point in space at the same time and phase their power will quadruple.

In analogy to electromagnetic waves the power, or acoustic intensity, of a waveform is proportional to the square of its pressure.

$$I = \frac{p^2}{\rho c} \text{ Watts/m}^2$$

Where the denominator is the value of the acoustic impedance of the medium, in this case air.

Therefore, generally the free-space, far-field power in the main lobe of the overpressure waveform can be calculated as $N^2$ of the pressure of a single detonation tube. However, when it is operated near the ground, advantage can also be taken of the additive effect of the ground wave. When the wave from the ground and the free-space waveforms converge on a target the pressures of both waveforms again add and quadruple the power again.

Beam steering is accomplished by adjusting the timing of the individual elements such that the closer ones are delayed just enough for the waves from the further part of the array to catch up. In a given steering direction therefore all of the waves will arrive at the same time and satisfy the $N^2$ power criterion. This is analogous to a phased array antenna but since the acoustic waveform is transient rather than continuous wave, time delay is substituted for phase.

Applications of the Overpressure Wave Generator of the Present Invention

The overpressure wave generator of the present invention, when operated at appropriate levels, for example 10 psi, can be used as a directed sound wave weapon system having the capability to render the recipients unconscious and permit their arrest and detainment. While innocent civilians who may be in the direction of the sound wave will likely be affected similarly, the effects are temporary and will not cause long-term injury. This permits the system to be used with a hair trigger and may even be operated under full automatic control while in particularly hostile environments without the usual concerns accompanying highly lethal systems. The system's non-lethal mode also allows it to be safely used for crowd control.

The directed sound wave weapon system is highly scalable and at more elevated overpressures can be used to achieve standoff distances and/or lethality. The system can be adapted to portable, individual use for deployment inside buildings and caves. In such environments the overpressure wave will propagate efficiently along hallways and cave tunnels that would serve as a wave guide increasing the system's effective range.

When an array of overpressure wave generators is used, the beam steering ability of the sound wave weapon system makes it very effective as an anti-sniper weapon since the sound waves can be directed accurately into windows hundreds of meters away. Since the beam can be electronically directed nearly instantaneously over a wide angle the weapon system can be set to automatically sweep the area around a convoy moving through hostile territory. In particular, the beam can be used to neutralize (i.e., destroy or disable) Improvised Explosive Devices (IEDs) and mines in the path of the convoy. FIGS. 13A and 13B provide side and back views of a soldier transporting a directed sound wave weapon as an attachment to his backpack. Referring to FIGS. 13A and 13B, soldier 1302 transports directed sound wave weapon 1304 that is attached to backpack 1306 storing a fuel-oxidant mixture supply. Under one arrangement, directed sound wave weapon 1304 comprises a single detonation tube 100. Under another arrangement, the directed sound wave weapon 1304 comprises an array of detonation tubes that may optionally be inside a carrying case or otherwise contained in a larger tube. Under still another arrangement directed sound wave weapon 1304 comprises an extendable graduated detonation tube arrangement where small diameter tubes can slide within larger diameter tubes allowing the graduated detonation tube arrangement to be compacted telescopically to have a length more conducive for transport by a soldier. FIGS. 13C and 13D depict such an arrangement where detonation tube 100A can slide inside detonation tube 100B which can slide inside detonation tube 100C. When compacted together, as shown in FIG. 13C, the length of the weapon 1304 is made shorter for transport and when the detonation tubes are pulled apart the weapon 1304 is extended making it capable of generating higher magnitude overpressure waves.

FIG. 14 illustrates a handheld directed sound wave weapon that can be used as both a battering ram and used to direct an overpressure wave at a target such as an enemy combatant. Referring to FIG. 14, handheld directed sound wave weapon 1400 comprises detonation tube 100 that receives fuel mixture 106 from backpack 1306 via fuel mixture supply 105. The handheld directed sound wave weapon 1400 also comprises a hand grip with a trigger 1404, optional second hand grip 1406, shoulder pad 1408 and optional battering ram 1412. Brace 1408 can be placed against a soldier's shoulder or against any sturdy object, for example a rock, doorway, or window frame, to absorb the recoil force of the weapon. Under one scenario, the battering ram is placed against a door and the weapon 1400 is fired causing its recoil force to break down the door. The weapon 1400 could then be directed through the doorway and braced against the doorframe using brace 1408 to enable the soldier to fire a second sound wave into a building in order to incapacitate its occupants. As shown, weapon 1400 comprises one detonation tube. However, weapon 1400 can comprise multiple detonation tubes configured in any of various ways described previously.

Figure 15:
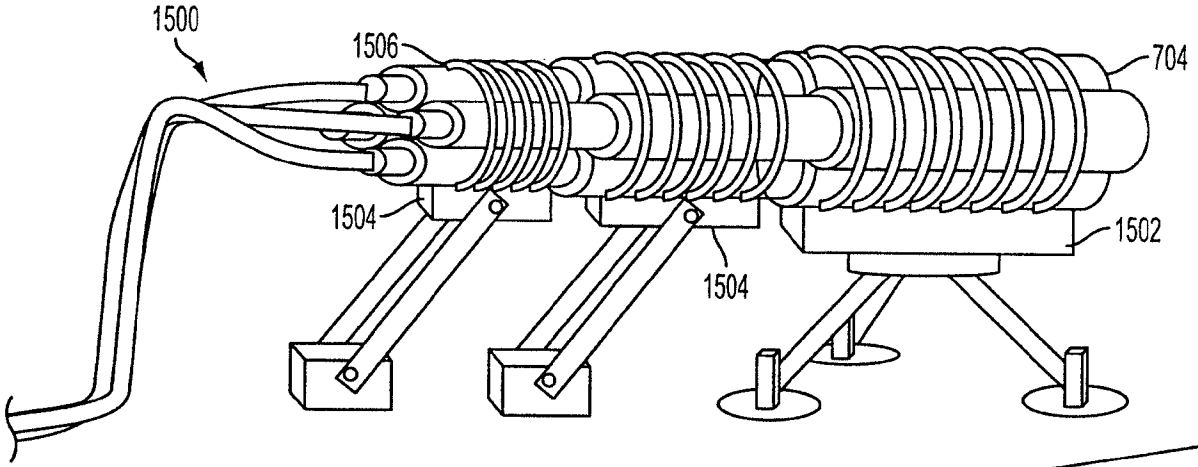
FIG. 15 illustrates a directed sound wave weapon secured to a tripod.

FIG. 15 illustrates a directed sound wave weapon comprising an array of four graduated detonation tubes secured to a tripod. Referring to FIG. 15, directed sound wave weapon 1500 comprises detonation tube array 704 mounted to tripod 1502 that can be secured to a surface, for example, staked into the ground. Tripod 1502 may be configured to swivel to provide the operator of the weapon 1500 greater ability to aim the weapon towards a target. Weapon 1500 also comprises bracing mechanisms 1504 intended, to transfer the recoil force of the weapon to the ground. Weapon 1500 is attached to the tripod 1502 and to bracing mechanisms 1504 using an attachment means such as strapping 1506. Although weapon 1500 as shown is configured to direct overpressure waves parallel to the ground, various well known methods can be used to allow weapon 1500 to direct overpressure waves in other directions.

Figure 16:
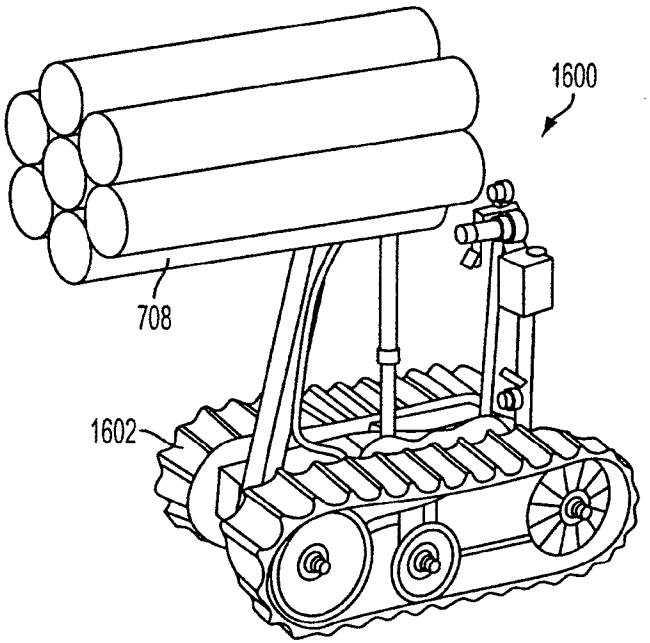
FIG. 16 illustrates a directed sound wave weapon attached to a robot.

FIG. 16 illustrates a directed sound wave weapon attached to a robot. Referring to FIG. 16, directed sound wave weapon 1600 comprises detonation tube array 708 mounted on robot 1602, which for example may be a Talon robot. Such robots are able to enter areas considered hazardous to personnel such as buildings or caves, can be used to detonate IEDs or mines, and can be used as part of an automated defense system.

Figure 17:
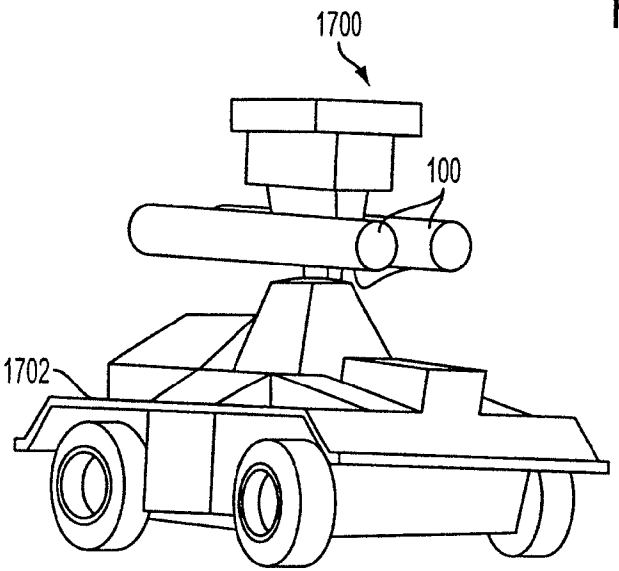
FIG. 17 illustrates two directed sound wave weapons attached to an unmanned ground vehicle.

FIG. 17 illustrates two directed sound wave weapons attached to an unmanned ground vehicle. As shown in FIG. 17, a directed sound wave weapon 1700 comprises unmanned ground vehicle 1702 and two detonation tubes 100. An unmanned ground vehicle is essentially a robot although typically of much larger size and therefore capable of carrying larger, more capable directed sound wave weaponry.

Although FIG. 17 depicts an unmanned ground vehicle, weapon 1700 could alternatively comprise an unmanned aerial vehicle.

Figure 18:
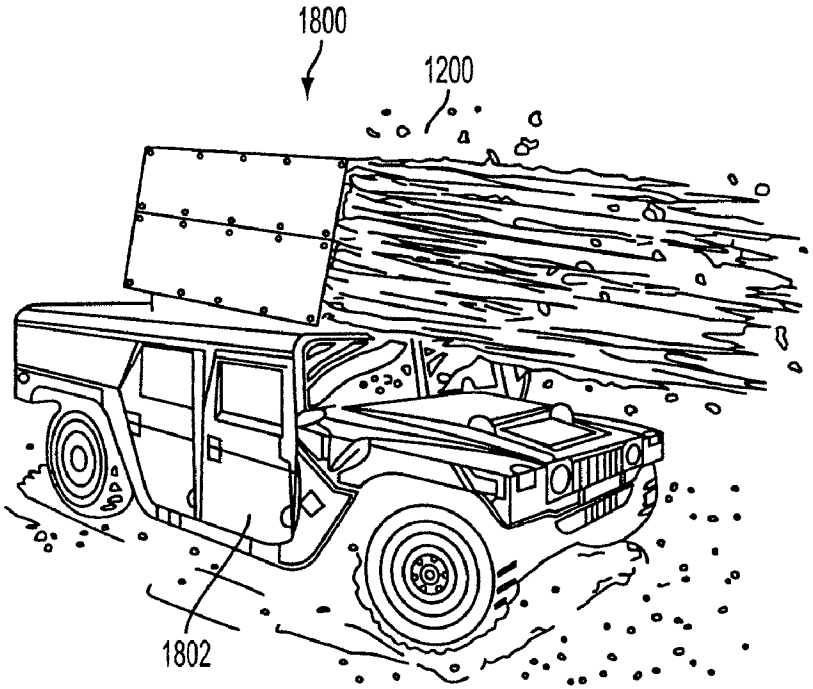
FIG. 18 illustrates the firing of a directed sound wave weapon system comprising a detonation tube array such mounted on top of a HMMV.

FIG. 18 illustrates the firing of a directed sound wave weapon system comprising a detonation tube array such mounted on top of a HMMV. As, shown in FIG. 18, a vehicle mounted directed sound wave weapon system 1800 comprises detonation tube array 1200 mounted on top of HMMV 1802. As depicted, all of the tubes of the array can be fired simultaneously to unleash a tremendous combined overpressure wave capable of significant destruction and lethality. Individual detonation tubes can also be fired so as to steer an overpressure wave towards a desired point, as described previously, which might be the window from which a sniper has been located. Although FIG. 18 depicts a HMMV, weapon 1800, and in general any directed sound wave system, can alternatively be mounted on all sorts of ground, air, and sea platforms such as armored personnel carriers, tanks, artillery platforms, airplanes, helicopters, boats, and ships. For example, directed sound wave weapon systems can be used on commercial ships to ward off pirates and by naval vessels to ward off approaching boats that might be rigged with explosives such as was the case with the U.S.S. Cole.

Figure 19:
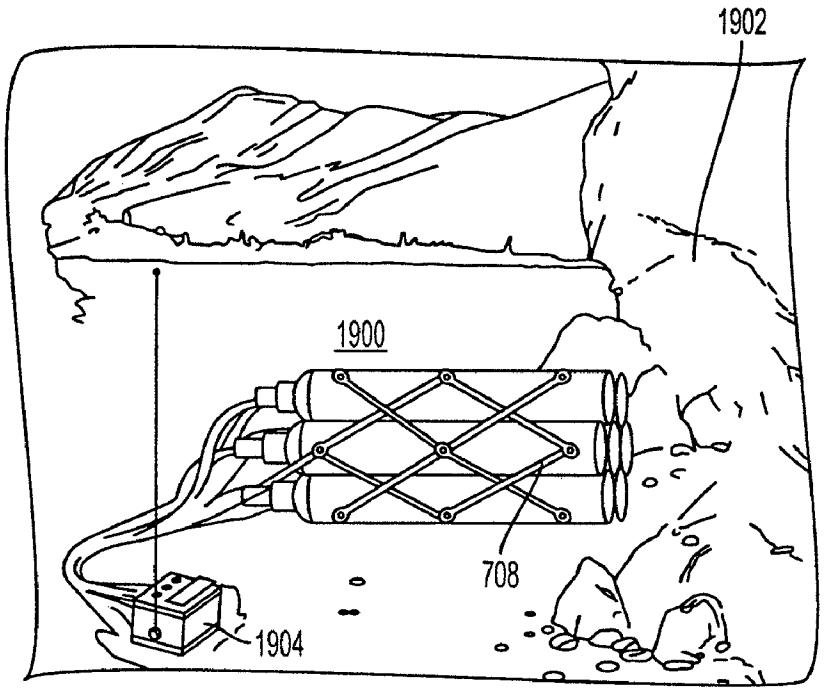
FIG. 19 depicts use of a directed sound wave weapon against a target hiding in a cave.

FIG. 19 depicts use of a directed sound wave weapon against a target hiding in a cave. Referring to FIG. 19, directed sound wave weapon 1900 comprises detonation tube array 708 that is directed into cave 1902. Weapon 1900 is configured to be controlled via remote control unit 1904. Optionally, weapon 1900 can be used in conjunction with a fuel fogging device capable of dispersing fuel into the cave. For example, a product named Dyna-Fog, is capable of dispersing 9 gallons of fuel per hour into a fuel-air mixture. Under this arrangement, the cave would itself become an extension to the detonation tube causing the detonation wave to proceed through the cave and eventually producing a devastating overpressure wave. This method can also be used in a building.

Figure 20:
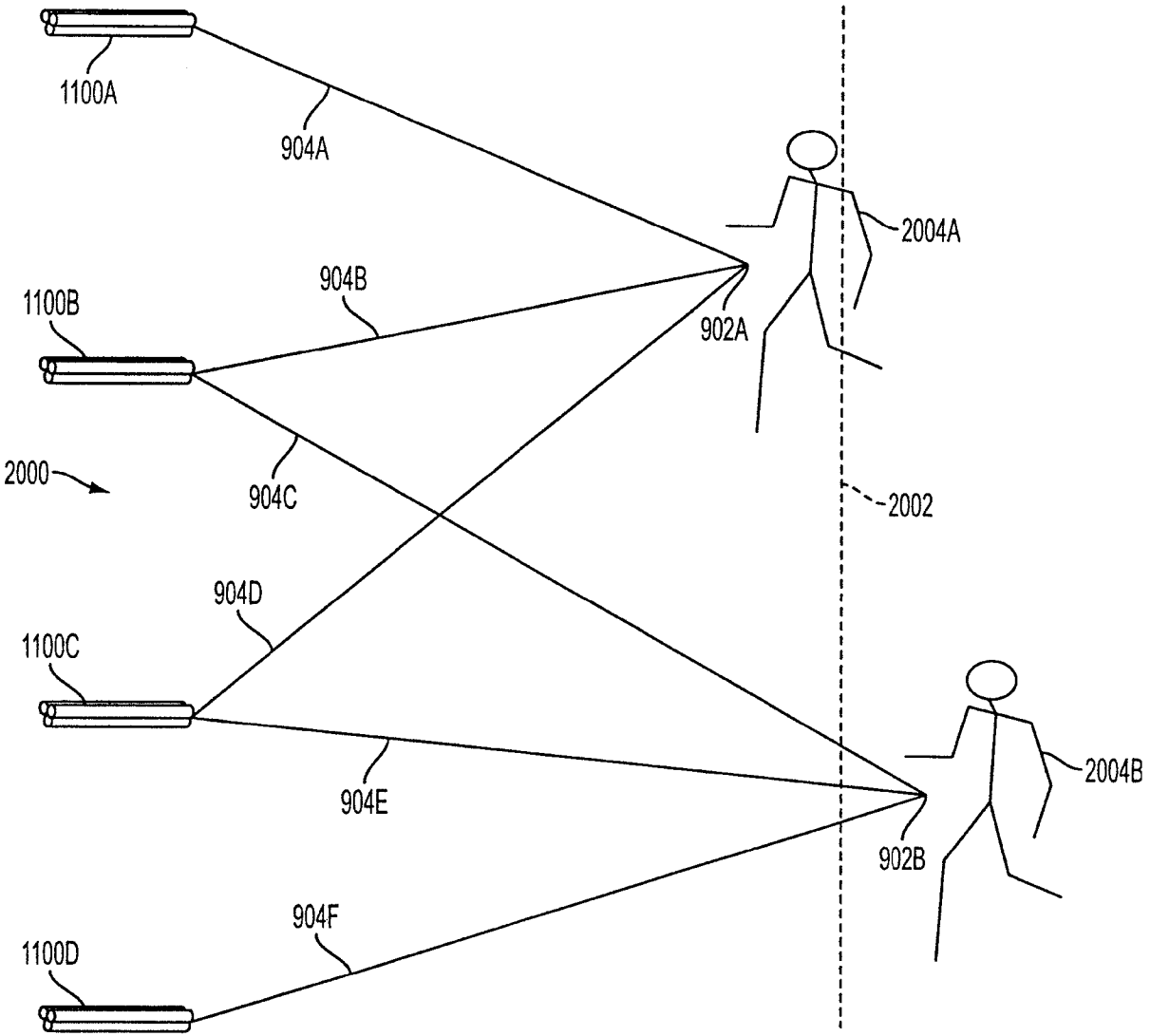
FIG. 20 depicts an exemplary perimeter defense system comprising a sparse array of directed sound wave weapons.

FIG. 20 depicts an exemplary perimeter defense system comprising a sparse array of directed sound wave weapons. As shown, perimeter defense system 2000 comprises a sparse array of four detonation tube groups 1100A-1100D arranged so as to defend perimeter 2002 against perpetrators 2004A and 2004B. The perimeter defense system 2000 is capable of using its beam steering capabilities to direct overpressure waves along direct paths 904A, 904B, and 904D to combine at point in space 902A to incapacitate perpetrator 2004A and similarly to direct overpressure waves along direct paths 904C, 904E, and 904F to combine at point in space 902B to incapacitate perpetrator 2004B. Such perimeter defense systems can comprises large numbers of directed sound wave weapons to protect perimeters covering great distances and having any shape. Typically, such perimeter defense systems would be used with sensors capable of determining the relative position of a perpetrator allowing the system to automatically adjust detonation tube timing so as to steer sound waves to the position of the perpetrator. Such perimeter defense systems 2000 can be used to keep people in or people out. For example, a perimeter defense system 2000 could be used to prevent prisoners from escaping and can be used to prevent someone from accessing a restricted area. As such, perimeter defense systems 2000 in accordance with the present invention can be used to defend military assets and for a host of homeland defense purposes such as protecting dams, power plants, water treatment plants, refineries, airports, fuel pipelines, oil wells, etc. Such systems can be used to deter illegal border crossings and to incapacitate those who choose to cross a border illegally.

Using the Recoil Force of an Overpressure Wave for a Water-based Weapon

Figure 21:
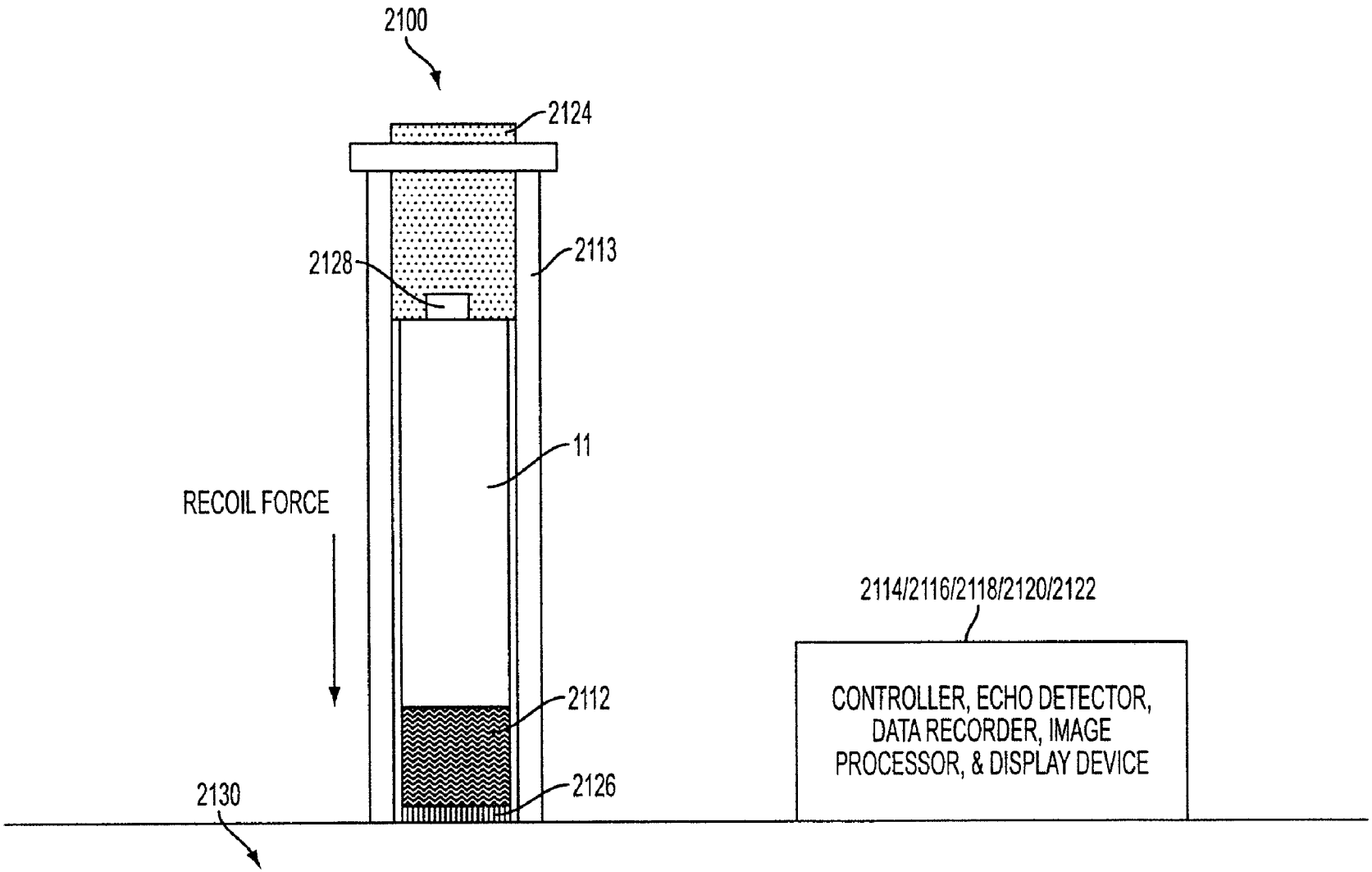
FIG. 21 depicts a system that harnesses the recoil force of the overpressure wave generator of the present invention for a water weapon.

The overpressure wave generator of the present invention described above can be augmented so as to harness its recoil force for use as a water-based weapon. In one embodiment of the water-based weapon system in accordance with the present invention, as shown in FIG. 21, water-based weapon system 2100 includes an overpressure wave generator 11, a coupling component 2112, a stabilizing mechanism 2113 for controlling the movement of the overpressure wave generator, a controller 2114 for controlling the operation of the overpressure wave generator 11. The system 2100 may optionally include a muffling apparatus 2124 which includes vent 2128 used to provide dilution gas (e.g., air) used to prevent detonation from continuing into the muffling apparatus 2124.

The overpressure wave generator 11 of system 2100 comprises what is depicted in FIG. 2B, 2C or 3B and may include any of the variations described above. It includes an electrical (or laser) source for producing a spark, a detonation tube, a gas mixture source that provides the flowing gas into the detonation tube, and a detonator. For the purposes of the description below, the overpressure wave generator can alternatively be a group of detonation tubes that are detonated simultaneously so as to produce a combined overpressure wave.

The overpressure wave generator is detonated to generate an overpressure wave, which is optionally muffled by muffler 2124. The generation of the overpressure wave causes a corresponding recoil force which coupling component 2112 couples to water to produce a conducted acoustic wave. Stabilizing mechanism 2113 provides stability to the movement of the overpressure wave generator 11 essentially allowing movement parallel to the tube. The coupling component 2112 may comprise rubber or some comparable compound having desired spring-like and damping characteristics and comprises a diaphragm 2126 that is in contact with the water.

The controller 2114 is used to control the operation of the overpressure wave generator 11. The controller 2114 can be a portable computer or workstation which is programmed to timing when the overpressure wave generator 11 is triggered.

Figure 22:
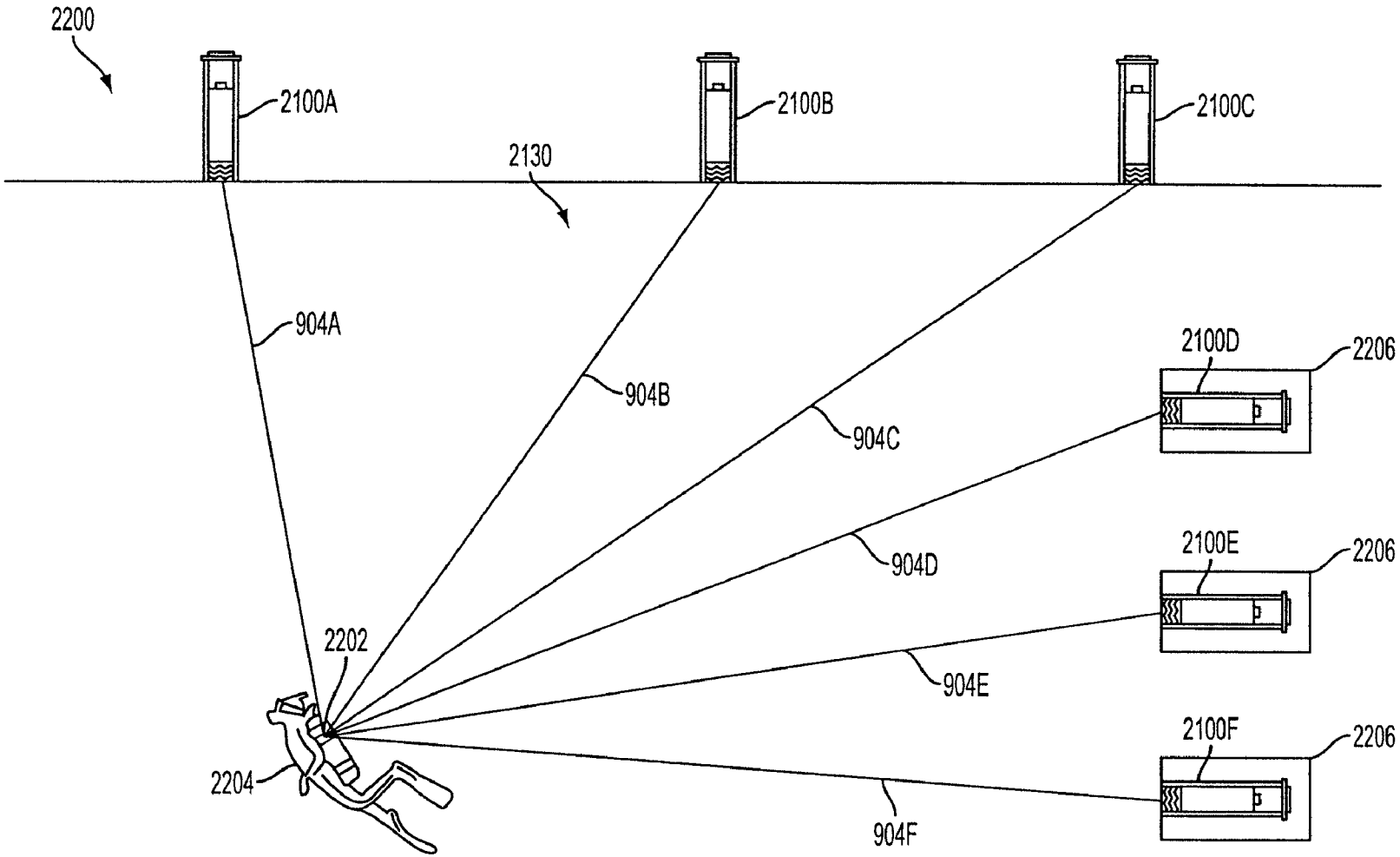
FIG. 22 illustrates an exemplary underwater defense system.

Multiple systems 2100 can be arranged in a sparse array and timing control methods used to steer their conducted acoustic waves such that they combine at a desired location within the water. Such steering is essentially done in the same manner similar as overpressure waves are steered, as described in relation to FIGS. 9-11 except it is accomplished with multiple time-controlled conducted acoustic waves. FIG. 22 illustrates an underwater defense system 2200 comprising multiple systems 2100A-2100C that can be controlled such that the conducted acoustic waves travel through the water via direct paths 904A-904C and combine at a point in the water 2202. Also shown are systems 2100D-2100F installed underwater in waterproof containment vessels 2206 being controlled such that the conducted acoustic waves travel through the water via direct paths 904D-904F such that they combine at a point in the water 2202. As such, system 2200 is capable of directing conducted acoustic waves to incapacitate an intruder/frogman/submarine 2204.

The system 2200 can be used to protect ships whereby the systems are installed into the hull of the ships or deployed alongside or near the ships. Similarly, such systems can be used to protect nuclear power facilities, off shore oil platforms, etc. from underwater terrorist attacks. Large scale systems can be used for harbor protection.

The weapon systems described herein can be used with a variety of well known sensor systems and targeting systems. Weapon system embodiments involving a sparse array of weapons will comprise a wired or wireless network and a control processor that controls the timing of detonations of the weapons so as to steer the overpressure waves or conducted acoustic waves to a target coordinate.

The weapon systems described herein were provided as examples of the types of weapons that are enabled by the present invention. While particular embodiments and several exemplary applications (or implementations) of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements which embody the spirit and scope of the present invention.

What is claimed is:

1. A system for producing a sound wave, comprising:

at least one detonation tube apparatus, comprising:

a detonation tube having a closed end and an open end;

a detonator having at least one spark initiator; and a fuel mixture supply subsystem for supplying a fuel-oxidant mixture to said detonator, said fuel-oxidant mixture flowing through said detonator and into the closed end of said detonation tube, said fuel mixture supply subsystem maintaining a mass ratio of fuel versus oxidant and a flow rate of said fuel-oxidant mixture to achieve detonation characteristics at an ignition point within said detonator; and a timing control mechanism for controlling the timing of said spark initiator, said spark initiator initiating a spark at said ignition point within said detonator while said fuel-oxidant mixture is flowing through said detonator thereby producing at said ignition point a detonation impulse that propagates into said closed end of said detonation tube, said detonation impulse initiating a detonation wave at the closed end of said detonation tube, said detonation wave propagating the length of said detonation tube and exiting the open end of said detonation tube as a sound wave.

2. The system of claim 1, wherein said mass ratio of fuel versus oxidant and said flow rate are selected based on the length and diameter of said detonator.

3. The system of claim 1, wherein said spark initiator is one of a high voltage pulse source, a triggered spark gap source, a laser, or an exploding wire.

4. The system of claim 1, wherein said timing control mechanism is one of a trigger mechanism, fixed logic, or a control processor.

5. The system of claim 1, wherein a control processor is used to control variable parameters of said fuel mixture supply subsystem.

6. The system of claim 1, wherein said fuel-oxidant mixture comprises one of gaseous or dispersed fuel.

7. The system of claim 1, wherein said fuel-oxidant mixture comprises at least one of ethane, methane, propane, hydrogen, butane, alcohol, acetylene, MAPP gas, gasoline, or aviation fuel.

8. The system of claim 1, wherein said fuel mixture supply subsystem also supplies a fuel-oxidant mixture directly to said at least one detonation tube.

9. The system of claim 1, wherein said timing control mechanism controls timing of detonation waves initiated in a plurality of detonation tubes to direct sound waves to a desired location.

10. The system of claim 9, wherein said directed sound waves are used for at least one of incapacitating a person, detonating a mine, or neutralizing an improvised explosives device.

11. The system of claim 1, wherein said at least one detonation tube apparatus comprises a plurality of detonation tube apparatuses arranged in a sparse array and said timing control mechanism controls timing of the detonation waves initiated in said plurality of detonation tube apparatuses to direct sound waves to a location.

12. The system of claim 11, wherein said directed sound waves are used for at least one of incapacitating a person, detonating a mine, neutralizing an improvised explosives device, defending a perimeter, or crowd control.

13. The system of claim 1, wherein said sound wave is used for at least one of incapacitating a person, detonating a mine, or neutralizing an improvised explosives device.

14. The system of claim 1, further comprising:

at least one coupling component corresponding to said at least one detonation tube apparatus, said at least one coupling components coupling a recoil force of said sound wave to water to produce a conducted acoustic wave.

15. The system of claim 14, wherein said at least one detonation tube apparatus comprises as plurality of detonation tube apparatuses arranged in a sparse array and said timing control mechanism controls timing of the detonation waves initiated in said plurality of detonation tube apparatuses to direct conducted acoustic waves to a desired location in the water.

16. The system of claim 1, further comprising:

at least one weapons platform.

17. The system of claim 16, wherein said at least one weapons platform is one of a tripod, a robot, an unmanned ground vehicle, an unmanned aerial vehicle, a HMMV, an armored personnel carrier, a boat, a ship, a helicopter, a tank, an artillery platform, an airplane, a soldier.

18. The system of claim 1, wherein said at least one detonation tube comprises one of a plurality of graduating detonation tubes, a plurality of detonation tubes, a detonation tube configured to compress said fuel-oxidant, mixture, or a detonation tube configured to expand said fuel-oxidant mixture.

19. A method for producing a sound wave, comprising the steps of:

supplying a fuel-oxidant mixture to a detonator having a spark initiator, said fuel-oxidant mixture flowing through said detonator and into the closed end of a detonation tube, said detonation tube also having an open end;

maintaining a mass ratio of fuel versus oxidant and a flow rate of said fuel-oxidant mixture to achieve detonation characteristics at an ignition point within said detonator; and controlling the timing of said spark initiator to initiate a spark at said ignition point within said detonator while said fuel-oxidant mixture is flowing through said detonator thereby producing at said ignition point a detonation impulse that propagates into said closed end of said detonation tube, said detonation impulse initiating a detonation wave at said closed end of said detonation tube, said detonation wave propagating the length of said detonation tube and exiting said open end of said detonation tube as a sound wave.

20. The method of claim 19, wherein said controlling the timing of said spark initiator causes a plurality of sound waves to be directed to a location.

* * * * *